US007847765B2

(12) United States Patent
Park et al.

(10) Patent No.: US 7,847,765 B2
(45) **Date of Patent: *Dec. 7, 2010**

(54) DISPLAY DEVICE AND DRIVING METHOD THEREOF

(75) Inventors: Sung-Chon Park, Suwon-si (KR); Won-Kyu Kwak, Suwon-si (KR); Yang-Wan Kim, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1343 days.

This patent is subject to a terminal disclaimer.

(21) Appl. No.: 11/312,016

(22) Filed: Dec. 19, 2005

(65) Prior Publication Data

US 2006/0145964 A1 Jul. 6, 2006

(30) Foreign Application Priority Data

Jan. 5, 2005 (KR) ..... 10-2005-0000759

(51) Int. Cl.
*G09G 3/32* (2006.01)

(52) U.S. Cl. ..... 345/82; 345/55; 345/76; 345/84

(58) Field of Classification Search ..... 345/55, 345/76, 77, 80, 82, 83, 84, 87, 88, 90, 92, 345/98, 100, 204, 690
See application file for complete search history.

(56) References Cited

U.S. PATENT DOCUMENTS 5,973,456 A * 10/1999 Osada et al. ..... 315/169.1
6,421,033 B1 7/2002 Williams et al.
6,661,180 B2 12/2003 Koyama
6,788,277 B2 * 9/2004 Kanauchi et al. ..... 345/77
6,859,193 B1 * 2/2005 Yumoto ..... 345/82
6,909,242 B2 6/2005 Kimura
7,109,953 B2 * 9/2006 Abe et al. ..... 345/76
7,129,643 B2 * 10/2006 Shin et al. ..... 315/169.3
7,138,967 B2 11/2006 Kimura
7,167,406 B2 * 1/2007 Komiya ..... 365/203
7,180,493 B2 * 2/2007 Shin et al. ..... 345/92
7,193,370 B2 * 3/2007 Kim ..... 315/169.1

(Continued)

FOREIGN PATENT DOCUMENTS

CN 1517965 A 8/2004

(Continued)

OTHER PUBLICATIONS

Patent Abstracts of Japan, Publication No. 09-138659, dated May 27, 1997, in the name of Chan-Long Shieh et al.

(Continued)

*Primary Examiner*—My-Chau T Tran
(74) *Attorney, Agent, or Firm*—Christie, Parker & Hale, LLP

(57) ABSTRACT

In an organic light emitting diode display, a plurality of sub-pixels sharing a select scan line that extends in a row direction forms a unit pixel, and the plurality of sub-pixels are arranged in a column direction in the unit pixel. A field is divided into a plurality of subfields, and corresponding one of the plurality of sub-pixels emits light in each of the plurality of subfields.

27 Claims, 32 Drawing Sheets

U.S. PATENT DOCUMENTS

| | | | | |
|---|---|---|---|---|
| 7,471,267 | B2 * | 12/2008 | Shin et al. | 345/76 |
| 7,508,365 | B2 * | 3/2009 | Kim | 345/76 |
| 2001/0022565 | A1 | 9/2001 | Kimura | |
| 2003/0128199 | A1 * | 7/2003 | Kimura | 345/204 |
| 2003/0218584 | A1 | 11/2003 | Kimura | |
| 2004/0070557 | A1 | 4/2004 | Asano et al. | |
| 2004/0252084 | A1 | 12/2004 | Miyagawa et al. | |
| 2005/0180083 | A1 | 8/2005 | Takahara et al. | |
| 2005/0242743 | A1 * | 11/2005 | Kwak | 315/160 |
| 2006/0139259 | A1 * | 6/2006 | Choi et al. | 345/76 |

FOREIGN PATENT DOCUMENTS

| | | | |
|---|---|---|---|
| EP | 1 331 627 | A2 | 7/2003 |
| EP | 1 441 325 | A2 | 7/2004 |
| EP | 1 441 325 | A3 | 12/2004 |
| EP | 1 600 924 | A1 | 11/2005 |
| JP | 09-138659 | A | 5/1997 |
| JP | 11-038379 | | 2/1999 |
| JP | 11-282426 | | 10/1999 |
| JP | 2002-352593 | | 12/2002 |
| JP | 2003-510661 | T | 3/2003 |
| JP | 2003-122306 | A | 4/2003 |
| JP | 2003-141893 | | 5/2003 |
| JP | 2003-150109 | | 5/2003 |
| JP | 2004-029230 | | 1/2004 |
| JP | 2004-029791 | A | 1/2004 |
| JP | 2005-338837 | | 12/2005 |
| JP | 2006-119639 | | 5/2006 |
| WO | WO 96/24123 | | 8/1996 |
| WO | WO/0124153 | A1 | 4/2001 |
| WO | WO 03/091977 | A1 | 11/2003 |

OTHER PUBLICATIONS

Patent Abstracts of Japan, Publication No. 2003-122306, dated Apr. 25, 2003, in the name of Akira Yumoto.

Patent Abstracts of Japan, Publication No. 2004-029791, dated Jan. 29, 2004, in the name of Oh-Kyong Kwon.

European Search Report for EP Application No. 06100105.3-2205 dated May 19, 2006.

European Search Report dated Feb. 14, 2007, for EP06100105.3, in the name of Samsung SDI Co., Ltd.

* cited by examiner

DISPLAY DEVICE AND DRIVING METHOD THEREOF

CROSS REFERENCE TO RELATED APPLICATION

This application claims priority to and the benefit of Korean Patent Application No. 10-2005-0000759 filed on Jan. 5, 2005 in the Korean Intellectual Property Office, the entire content of which is incorporated herein by reference.

BACKGROUND OF THE INVENTION

1. Field of the Invention

The present invention relates to a display device and a driving method thereof, and more particularly, to an organic light emitting diode (OLED) display device and a driving method thereof.

2. Description of the Related Art

In general, the organic light emitting diode display device is a display device for electrically exciting phosphorous organic matter and emitting light. The organic light emitting diode display device drives organic light emission cells arranged in a matrix format to represent images. An organic light emission cell having a diode characteristic is referred to as an organic light emitting diode (OLED) and has a structure including an anode electrode layer, an organic thin film, and a cathode electrode layer. Holes and electrons injected through the anode electrode and the cathode electrode are combined on the organic thin film, and emit light. The organic light emission cell emits different amounts of light according to injected amounts of electrons and holes, that is, depending on the applied current.

In a display device such as the organic light emitting diode display device, a pixel includes a plurality of sub-pixels each of which has one of a plurality of colors (e.g., primary colors of light), and colors are represented through combinations of the colors emitted by the sub-pixels. In general, a pixel includes a sub-pixel for displaying red (R), a sub-pixel for displaying green (G), and a sub-pixel for displaying blue (B), and the colors are displayed by combinations of red, green, and blue (RGB) colors. Generally, the sub-pixels are arranged in an order of R, G, and B along a row direction.

Each sub-pixel in the organic light emitting diode display device includes a driving transistor for driving the organic light emitting diode, a switching transistor, and a capacitor. Also, each sub-pixel has a data line for transmitting (or applying) a data signal, and a power line for transmitting (or applying) a power supply voltage. Therefore, many wires are required for transmitting (or applying) voltages or signals to the transistors and capacitors formed at each pixel. It is difficult to arrange such wires in the pixel, and the aperture ratio corresponding to a light emission area of the pixel is reduced.

SUMMARY OF THE INVENTION

One exemplary embodiment of the present invention provides a display device for improving an aperture ratio.

Another exemplary embodiment of the present invention provides a display device for simplifying the arrangement of wires and elements in unit pixels.

Still another exemplary embodiment of the present invention provides a display device for reducing a number of select scan lines.

Further, another exemplary embodiment of the present invention provides a scan driver for reducing a number of flip-flops.

In one aspect of the present invention, a display device including a plurality of unit pixels, a plurality of data lines, a plurality of select scan lines, a plurality of emit scan lines, and a scan driver is provided. A field is divided into a plurality of subfields. The plurality of unit pixels are arranged in rows and display an image during the field. Each of the unit pixels includes a plurality of light emitting elements arranged in a column direction. The plurality of data lines extend in the column direction, and transmit data signals. The plurality of select scan lines extend in a row direction and transmit select signals, and each of the select scan lines is coupled to a corresponding one of the rows of the unit pixels. The plurality of emit scan lines transmit emission control signals, and each of the emit scan lines is coupled to a corresponding one of the rows of the unit pixels. The scan driver applies the select signals to the select scan lines, and applies the emission control signals to the emit scan lines, in each of the plurality of subfields. At least one of the unit pixels uses a corresponding one of the data signals in response to a first signal of a corresponding one of the select signals, and each of the plurality of light emitting elements of the at least one of the unit pixels emits light in response to an emit signal of a corresponding one of the emission control signals in a corresponding one of the subfields.

In another aspect of the present invention, a display device including a plurality of unit pixels, a plurality of data lines, a plurality of select scan lines, a plurality of emit scan lines, a first scan driver, and a second scan driver is provided. A field is divided into a plurality of subfields. The plurality of unit pixels are arranged in rows and display an image during the field. Each of the unit pixels includes a plurality of light emitting elements arranged in a column direction. The plurality of data lines extend in the column direction and transmit data signals. The plurality of select scan lines extend in a row direction and transmit select signals, and each of the select scan lines is coupled to a corresponding one of the rows of the unit pixels. The plurality of emit scan lines transmit emission control signals, and each of the emit scan lines is coupled to a corresponding one of the rows of the unit pixels. The first scan driver applies the select signals to the select scan lines of a first row group from among the rows of the unit pixels and applies the emission control signals to the emit scan lines of the first row group, in each of the plurality of subfields. The second scan driver applies the select signals to the select scan lines of a second row group from among the rows of the unit pixels and applies the emission control signals to the emit scan lines of the second row group, in each of the plurality of subfields. At least one of the unit pixels uses a corresponding one of the data signals in response to a first signal of a corresponding one of the select signals, and each of the plurality of light emitting elements of the at least one of the unit pixels emits light in response to an emit signal of a corresponding one of the emission control signals in a corresponding one of the subfields.

In still another aspect of the present invention, a pixel circuit driving method of a display device is provided. The display device includes a plurality of data lines that extend in a first direction and transmitting data signals, a plurality of select scan lines that extend in a second direction and transmitting select signals, and a plurality of unit pixels. Each of the unit pixels includes a plurality of sub-pixels. At least one of the select signals is applied to a corresponding one of the plurality of select scan lines in a first subfield of a field, and at least one of the data signals is applied to at least one of the plurality of data lines. A first emission control signal is applied to at least one of the unit pixels to which a corresponding one of the select signals and a corresponding one of the data signals are applied, so that a first sub-pixel of the plurality of sub-pixels emits light. At least one of the select signals is applied to a corresponding one of the plurality of select scan lines in a second subfield of the field, and at least one of the data signals is applied to at least one of the plurality of data lines. A second emission control signal is applied to at least one of the unit pixels to which a corresponding one of the select signals and a corresponding one of the data signals are applied so that a second sub-pixel of the plurality of sub-pixels emits light, and the first and second sub-pixels are arranged in the first direction.

In a further aspect of the present invention, a display device including a display area, a first driver, and a second driver is provided. The display area includes a plurality of data lines that extend in a first direction, a plurality of select scan lines that extend in a second direction, and a plurality of unit pixels. Each of the unit pixels includes a plurality of sub-pixels arranged in the first direction. The first driver sequentially transmits select signals to the plurality of select scan lines in each of a plurality of subfields that form a field, and transmits emission control signals to corresponding at least one of the plurality of sub-pixels in each of the plurality of subfields to emit light in the corresponding at least one of the plurality of sub-pixels. The second driver transmits a data signal to at least one of the data lines of the unit pixels coupled to a corresponding one of the select scan lines to which one of the select signals is applied. The first driver generates the emission control signals respectively corresponding to the plurality of subfields using a first shift signal.

BRIEF DESCRIPTION OF THE DRAWINGS

The accompanying drawings illustrate exemplary embodiments of the present invention, and, together with the description, serve to explain the principles of the invention, wherein.

DETAILED DESCRIPTION

Figure 1:
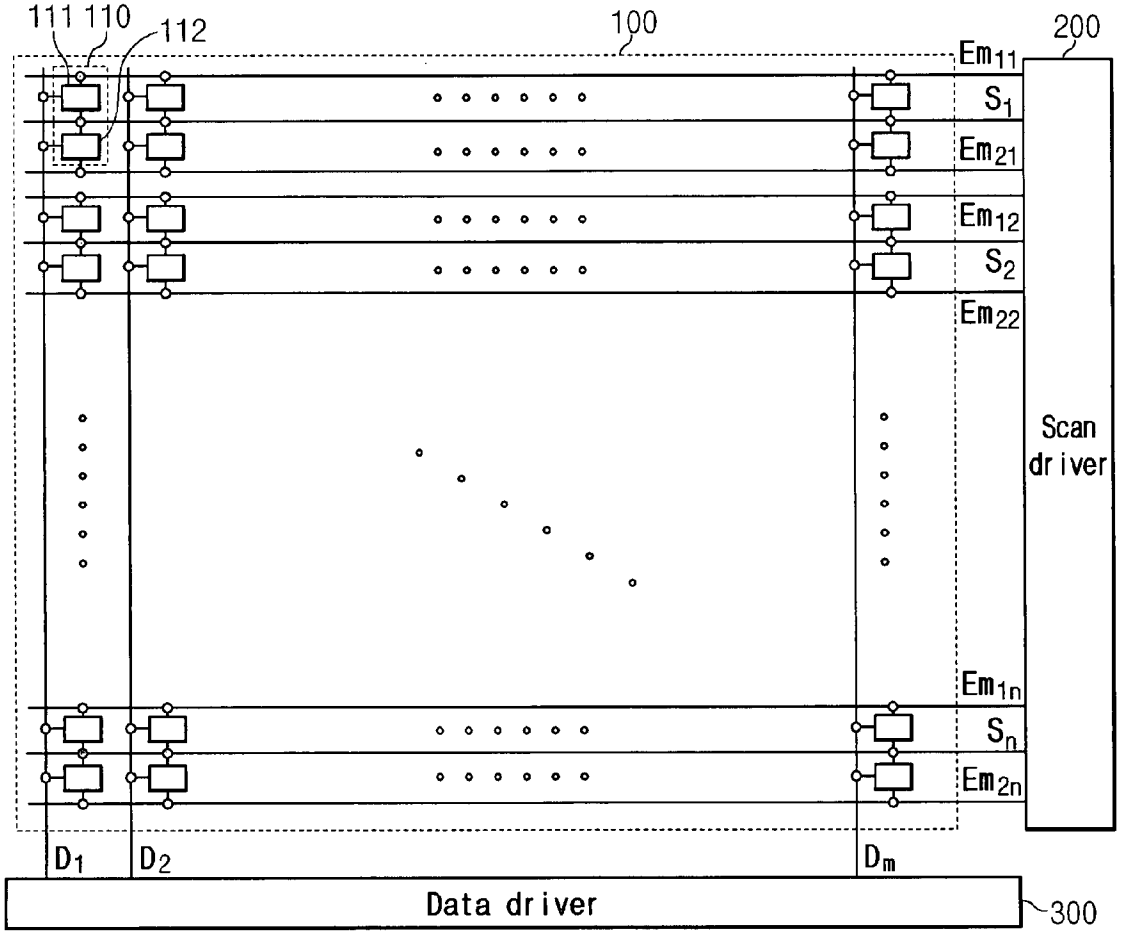
FIG. 1 shows a plan view of an organic light emitting diode display device according to a first exemplary embodiment of the present invention.

In the following detailed description, only certain exemplary embodiments of the present invention are shown and described, simply by way of illustration. As those skilled in the art would realize, the described embodiments may be modified in various different ways, all without departing from the spirit or scope of the present invention.

Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements. Phrases such as "one thing is coupled to another" can refer to either "a first one is directly coupled to a second one" or "the first one is coupled to the second one with a third one provided therebetween".

A display device and a driving method thereof according to exemplary embodiments of the present invention will be described in detail with reference to the drawings, and an organic light emitting diode display device using an organic light emitting diode as a light emitting element will be exemplified and described in the exemplary embodiments.

FIG. 1 shows a plan view of an organic light emitting diode display device according to a first exemplary embodiment of the present invention.

As shown in FIG. 1, the organic light emitting diode display device includes a display area 100 seen as a screen to a user, a scan driver 200, and a data driver 300.

The display area 100 includes a plurality of data lines $D_1$ to $D_m$, a plurality of select scan lines $S_1$ to $S_n$, a plurality of emit scan lines $Em_{11}$ to $Em_{1n}$ and $Em_{21}$ to $Em_{2n}$, and a plurality of unit pixels 110. Each unit pixel 110 includes two sub-pixels 111 and 112 which are arranged in a column direction. The data lines $D_1$ to $D_m$ are extended in a column direction and transmit data signals representing images to the corresponding unit pixels. The select scan lines $S_1$ to $S_n$ are extended in a row direction and transmit select signals for selecting corresponding lines to the select scan lines $S_1$ to $S_n$ in order to apply data signals to the unit pixels of the corresponding lines. The emit scan lines $Em_{11}$ to $Em_{1n}$ and $Em_{21}$ to $Em_{2n}$ are extended in a row direction and transmit emission control signals for controlling light emission of the respective sub-pixels 111 or 112 to the corresponding unit pixels 110. The unit pixel 110 is defined in an area where the select scan lines $S_1$ to $S_n$ and the data lines $D_1$ to $D_m$ are crossed. The scan lines $S_1$ to $S_n$ are coupled to the sub-pixels 111 and 112 in the respective unit pixels 110.

One field is divided into two subfields, and the scan driver 200 sequentially transmits select signals to the select scan lines $S_1$ to $S_n$ in the respective subfields. The scan driver 200 sequentially transmits emission control signals for controlling light emission of the sub-pixels 111 to the emit scan lines $Em_{11}$ to $Em_{1n}$ in one subfield, and sequentially transmits emission control signals for controlling light emission of the sub-pixels 112 to the emit scan lines $Em_{21}$ to $Em_{2n}$ in the other subfield. The data driver 300 applies data signals corresponding to the pixels of lines to which select signals are applied to the data lines $D_1$ to $D_m$ each time the select signals are sequentially applied. In addition, the data driver 300 applies data signals corresponding to the sub-pixels 111 in the one subfield, and applies data signals corresponding to the sub-pixels 112 in the other subfield.

The scan driver 200 and the data driver 300 are coupled to a substrate in which the display area 100 is formed. Alternatively, the scan driver 200 and/or the data driver 300 may be installed directly on the substrate, and they may be substituted with a driving circuit which is formed on the same layer on the substrate as the layer on which scan lines, data lines, and transistors are formed. Alternatively, the scan driver 200 and/or the data driver 300 may be installed in a chip format on a tape carrier package (TCP), a flexible printed circuit (FPC), or a tape automatic bonding unit (TAB) coupled to the substrate.

Figure 2:
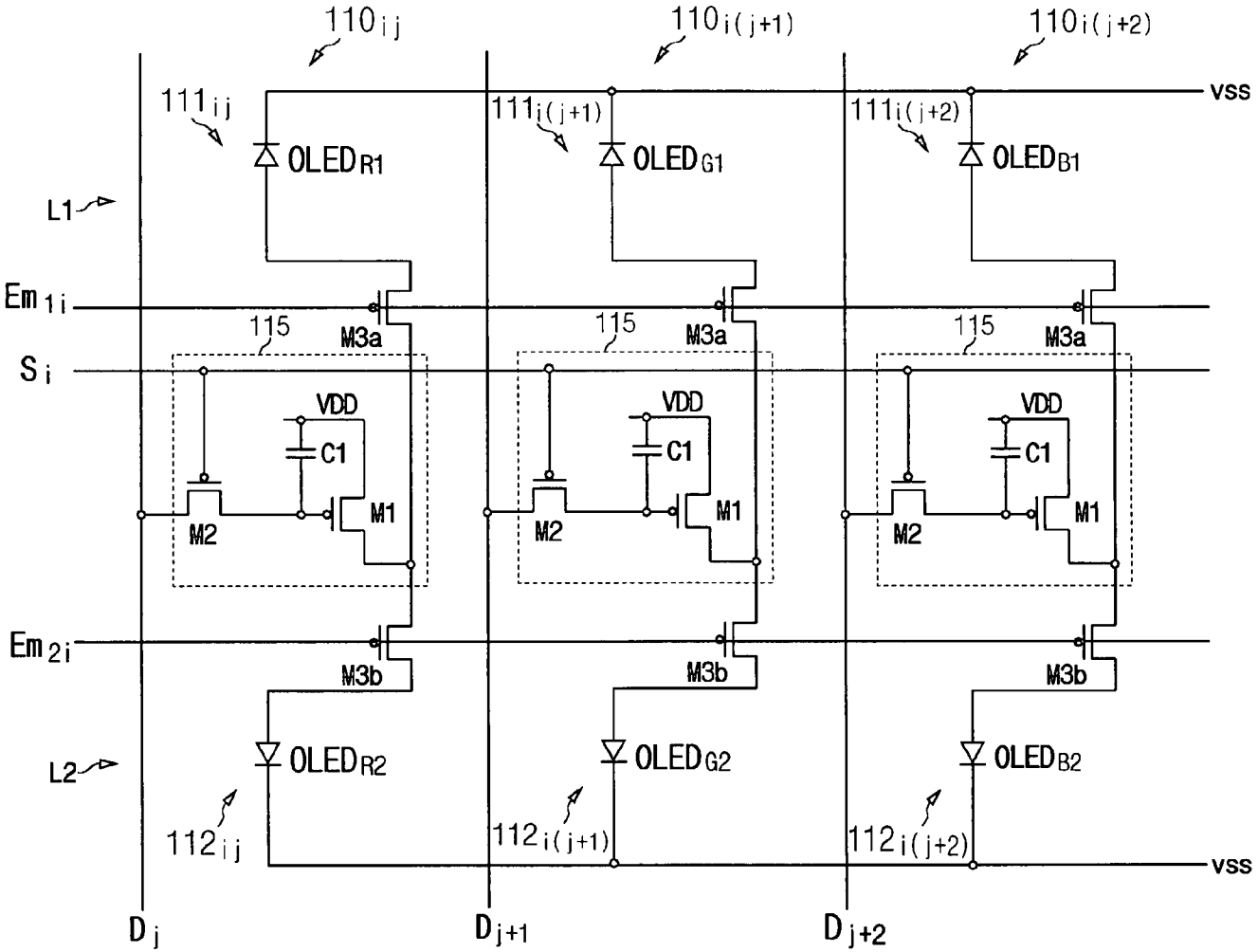
FIG. 2 shows a simplified circuit diagram of unit pixels of the organic light emitting diode display device shown in FIG. 1.

FIG. 2 shows a simplified circuit diagram of the unit pixels of the organic light emitting diode display device shown in FIG. 1. The three unit pixels $\mathbf{110}_{ij}$, $\mathbf{110}_{i(j+1)}$, and $\mathbf{110}_{i(j+2)}$ coupled to the scan line $S_i$ of the $i^{th}$ row (where 'i' is a positive integer less than or equal to 'n') and the data lines $D_j$ to $D_{j+2}$ of the $j^{th}$ to $(j+2)^{th}$ columns (where 'j' is a positive integer less than or equal to 'm−2') will be exemplified in FIG. 2. It is assumed that the sub-pixels are arranged in an order of R, G, and B along the row direction, and the same color sub-pixels are arranged along the column direction in FIG. 2.

As shown in FIG. 2, the two sub-pixels 111 and 112 of the one unit pixel 100 are coupled to one of the select scan lines $S_1$ to $S_n$ in common and have a pixel driver 115 in common, and the pixel driver 115 includes a driving transistor M1, a switching transistor M2, and a capacitor C1.

In more detail, the unit pixel $\mathbf{110}_{ij}$ coupled to the $i^{th}$ select scan line $S_i$ and the $j^{th}$ data line $D_j$ includes the pixel driver 115, a switching unit, and two organic light emitting diodes $OLED_{R1}$ and $OLED_{R2}$ that emit red light. The switching unit includes two emission control transistors M3*a* and M3*b* to selectively transmit a driving current from the pixel driver 115 to the two organic light emitting diodes $OLED_{R1}$ and $OLED_{R2}$. In addition, the sub-pixels $\mathbf{111}_{ij}$ and $\mathbf{112}_{ij}$ respectively include the two organic light emitting diodes $OLED_{R1}$ and $OLED_{R2}$ in the unit pixel $\mathbf{110}_{ij}$.

The unit pixel $\mathbf{110}_{i(j+1)}$ coupled to the $i^{th}$ select scan line $S_i$ and the $(j+1)^{th}$ data line $D_{j+1}$, and the unit pixel $\mathbf{110}_{i(j+2)}$ coupled to the $i^{th}$ select scan line $S_i$ and the $(j+2)^{th}$ data line $D_{j+2}$ have the same structures as the unit pixel $\mathbf{110}_{ij}$. In addition, the sub-pixels $\mathbf{111}_{i(j+1)}$ and $\mathbf{112}_{i(j+1)}$ respectively include two organic light emitting diodes $OLED_{G1}$ and $OLED_{G2}$ that emit green light in the unit pixel $\mathbf{110}_{i(j+1)}$, and the sub-pixels $\mathbf{111}_{i(j+2)}$ and $\mathbf{112}_{i(j+2)}$ respectively include two organic light emitting diodes $OLED_{B1}$ and $OLED_{B2}$ that emit blue light in the unit pixel $\mathbf{110}_{i(j+2)}$.

In the unit pixel $\mathbf{110}_{ij}$, the driving transistor M1 has a source coupled to a power line for supplying a power supply voltage VDD, and a gate coupled to a drain of the switching transistor M2. The capacitor C1 is coupled between the source and the gate of the driving transistor M1. The switching transistor M2 having a gate coupled to the select scan line $S_i$ and a source coupled to the data line $D_j$, transmits (or applies) the data signal converted to analog voltage (hereinafter, "data voltage") provided by the data line $D_j$ in response to the select signal provided by the select scan line $S_i$. The driving transistor M1 has a drain coupled to sources of the emission control transistors M3*a* and M3*b*, and gates of the emission control transistors M3*a* and M3*b* are coupled to the emit scan lines $Em_{1i}$ and $Em_{2i}$, respectively. Drains of the emission control transistors M3*a* and M3*b* are coupled, respectively, to anodes of the organic light emitting diodes $OLED_{R1}$ and $OLED_{R2}$, and a power supply voltage VSS is applied to cathodes of the organic light emitting diodes $OLED_{R1}$ and $OLED_{R2}$. The power supply voltage VSS in the first exemplary embodiment is lower than the voltage VDD, and can be a negative voltage or a ground voltage. As shown in FIG. 2, the unit pixels $\mathbf{110}_{i(j+1)}$ and $\mathbf{110}_{i(j+2)}$ have the same connecting structure as the unit pixel $\mathbf{110}_{ij}$.

In the unit pixel $\mathbf{110}_{ij}$, the one emit scan line $Em_{1i}$ of the emit scan lines $Em_{1i}$ and $Em_{2i}$ is coupled to the gates of the transistors M3*a* respectively coupled to the organic light emitting diodes $OLED_{R1}$, $OLED_{G1}$ and $OLED_{B1}$, and the other emit scan line $Em_{2i}$ is coupled to the gates of the transistors M3*b* respectively coupled to the organic light emitting diodes $OLED_{R2}$, $OLED_{G2}$ and $OLED_{B2}$.

A low-level emission control signal is applied to the emit scan line $Em_{1i}$ in one subfield of two subfields forming a field, and therefore, the transistor M3*a* is turned on. Then, a current $I_{OLED}$ as expressed in Equation 1 flows from the transistor M1 to the organic light emitting diode so that the organic light emitting diodes $OLED_{R1}$, $OLED_{G1}$ and $OLED_{B1}$ emit light corresponding to the magnitude of the current $I_{OLED}$. A low-level emission control signal is applied to the emit scan line $Em_{2i}$ in the other subfield, and therefore, the transistor M3*b* is turned on. Then, a current $I_{OLED}$ flows from the transistor M1 to the organic light emitting diode so that the organic light emitting diodes $OLED_{R2}$, $OLED_{G2}$ and $OLED_{B2}$ emit light.

$$I_{OLED} = \frac{\beta}{2}(|V_{SG}| - |V_{TH}|)^2 \qquad \text{Equation 1}$$

where β is a constant determined by a channel width and a channel length of the transistor M1, $V_{SG}$ is a voltage between the source and the gate of the transistor M1, and $V_{TH}$ is a threshold voltage of the transistor M1.

Referring to FIG. 2, an upper line L1 is formed by the organic light emitting diodes $OLED_{R1}$, $OLED_{G1}$ and $OLED_{B1}$, and a lower line L2 is formed by the organic light emitting diodes $OLED_{R2}$, $OLED_{G2}$ and $OLED_{B2}$. The organic light emitting diodes of the upper line L1 start emitting light in one subfield of the fields, and the organic light emitting diodes of the lower line L2 start emitting light in the other subfield of the fields.

Figure 3:
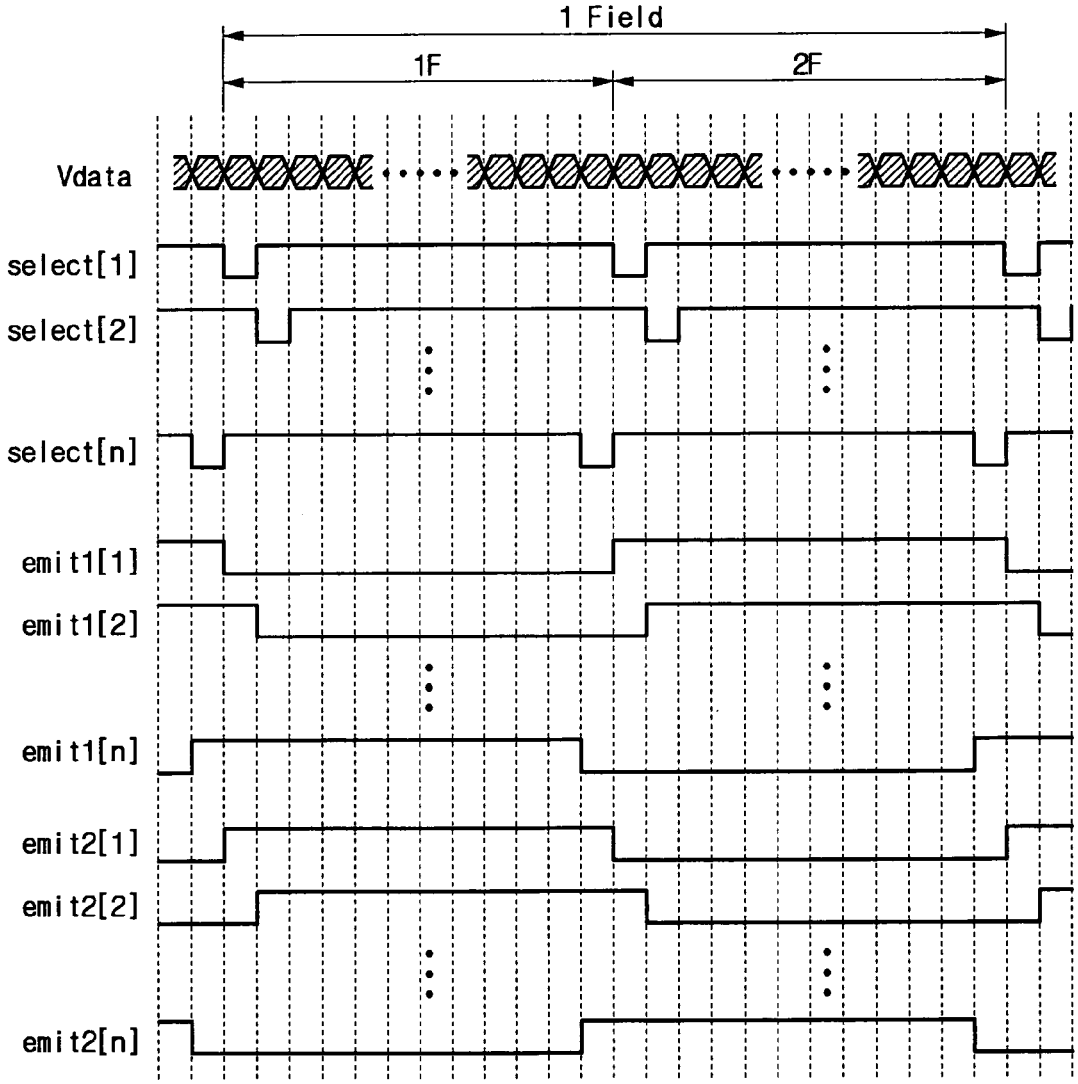
FIG. 3 shows a signal timing diagram of the organic light emitting display device according to the first exemplary embodiment of the present invention.

A driving method of the organic light emitting diode display device according to the first exemplary embodiment of the present invention will be described in detail with reference to FIG. 3. In FIG. 3, the select signal applied to the select scan line $S_i$ is depicted as 'select[i]', and the emission control signals applied to the emit scan lines $Em_{1i}$ and $Em_{2i}$ are depicted as 'emit1[*i*]' and 'emit2[*i*]', respectively.

As shown in FIG. 3, one field includes two subfields 1F and 2F, and low-level select signals are sequentially applied to the select scan lines $S_1$ to $S_n$ in each subfield 1F or 2F. The two organic light emitting diodes of the unit pixel that share the select scan line emit light during periods corresponding to subfields 1F and 2F, respectively. In FIG. 3, widths of low-level signals (e.g., pulses) of the emission control signals emit1[*i*] and emit2[*i*] are the same as periods corresponding to the subfields 1F and 2F, respectively.

In the first subfield 1F, when a low-level select signal select[1] is applied to the select scan line $S_1$ on the first row, data voltages corresponding to the organic light emitting diodes $OLED_{R1}$, $OLED_{G1}$ and $OLED_{B1}$ of the unit pixels on the first row are applied to the corresponding data lines $D_1$-$D_m$. A low-level emission control signal emit1[1] is applied to the emit scan line $Em_{11}$ on the first row, and the emission control transistors M3*a* of the unit pixels on the first row are turned on. Then, currents corresponding to the data voltages are transmitted to the corresponding organic light emitting diodes $OLED_{R1}$, $OLED_{G1}$ and $OLED_{B1}$ from the driving transistors M1 to thus emit light in the upper line L1 on the first row. The light is emitted during the period in which the emission control signal emit1[1] is low-level.

Next, when a low-level select signal select[2] is applied to the select scan line $S_2$ on the second row, data voltages corresponding to the organic light emitting diodes $OLED_{R1}$, $OLED_{G1}$ and $OLED_{B1}$ of the unit pixels on the second row are applied to the corresponding data lines $D_1$-$D_m$. A low-level emission control signal emit1[2] is applied to the emit scan line $Em_{12}$ on the second row, and the emission control transistors M3*a* of the unit pixels on the second row are turned on. Then, the organic light emitting diodes $OLED_{R1}$, $OLED_{G1}$ and $OLED_{B1}$ on the upper line L1 of the second row emit light in response to the low-level emission control signal emit1[2]. The light is emitted during the period in which the emission control signal emit1[2] is low-level.

In a like manner, low-level select signals select[1] to select [n] are sequentially applied to the select scan lines $S_1$ to $S_n$ on the first to $n^{th}$ rows in the first subfield 1F. When the low-level select signal select[i] is applied to the select scan line $S_i$ on the $i^{th}$ row, the data voltages corresponding to the organic light emitting diodes $OLED_{R1}$, $OLED_{G1}$ and $OLED_{B1}$ of the unit pixels on the $i^{th}$ row are applied to the corresponding data line $D_1$ to $D_m$, and a low-level emission control signal emit1[*i*] is applied to the emit scan line $Em_{1i}$ of the $i^{th}$ row. Then, the organic light emitting diodes $OLED_{R1}$, $OLED_{G1}$ and $OLED_{B1}$, which are formed on the upper line L1 of the $i^{th}$ row, emit light during a period corresponding to the width of the low-level emission control signal emit1[*i*].

In the second subfield 2F, a low-level select signal select[1] is applied to the select scan line $S_1$ on the first row, and data voltages corresponding to the organic light emitting diodes $OLED_{R2}$, $OLED_{G2}$ and $OLED_{B2}$ of the unit pixels on the first row are applied to the corresponding data lines $D_1$-$D_m$. A low-level emission control signal emit2[1] is applied to the emit scan line $Em_{21}$ on the first row, and the emission control transistors M3*b* of the unit pixels on the first row are turned on. Then, the organic light emitting diodes $OLED_{R2}$, $OLED_{G2}$ and $OLED_{B2}$ on the lower line L2 of the first row emit light during the period in which the emission control signal emit2[1] is low-level.

Next, a low-level select signal select[2] is applied to the select scan line $S_2$ on the second row, and data voltages corresponding to the organic light emitting diodes $OLED_{R2}$, $OLED_{G2}$ and $OLED_{B2}$ of the unit pixels on the second row are applied to the corresponding data lines $D_1$-$D_m$. A low-level emission control signal emit2[2] is applied to the emit scan line $Em_{22}$ on the second row, and the emission control transistors M3*b* of the unit pixels on the second row are turned on. Then, the organic light emitting diodes $OLED_{R2}$, $OLED_{G2}$ and $OLED_{B2}$ on the lower line L2 of the second row emit light during the period in which the emission control signal emit2[2] is low-level.

In a like manner, low-level select signals select[1] to select [n] are sequentially applied to the select scan lines $S_1$ to $S_n$ on the first to $n^{th}$ rows in the second subfield 2F. When the low-level select signal select[i] is applied to the select scan line $S_i$ on the $i^{th}$ row, the data voltages corresponding to the organic light emitting diodes $OLED_{R2}$, $OLED_{G2}$ and $OLED_{B2}$ of the unit pixels on the $i^{th}$ row are applied to the corresponding data line $D_1$ to $D_m$, and a low-level emission control signal emit2[*i*] is applied to the emit scan line $Em_{2i}$ of the $i^{th}$ row. Then, the organic light emitting diodes $OLED_{R2}$, $OLED_{G2}$ and $OLED_{B2}$, which are formed on the lower line L2 of the $i^{th}$ row, emit light in during a period corresponding to the width of the low-level emission control signal emit2[*i*].

As described above, one field is divided into the two subfields, and the subfields are sequentially driven in the organic light emitting diode display device driving method according to the first exemplary embodiment. The organic light emitting diodes formed on the upper line L1 of the each row start emitting light in one subfield, and the organic light emitting diodes formed on the lower line L2 of the each row start emitting light in the other subfield. As a result, the organic light emitting diodes of all sub-pixels formed on 2n lines of n rows can emit light in the one field. In addition, the number of select scan lines and the number of pixel drivers (e.g., the transistors and the capacitors) can be reduced since the two sub-pixels share the select scan line and the pixel driver. As a result, the number of integrated circuits for driving the select scan lines can be reduced, and the elements can be easily arranged in the unit pixel.

Further, the scan driver and the data driver of the interlace scan method may be applicable to those according to the first exemplary embodiment of the present invention because the lower lines L2 are scanned after the upper lines L1 are scanned in the first exemplary embodiment. In addition, the single scan method is applicable to the organic light emitting diode display device in FIG. 3, but the dual scan method may also be applicable to the organic light emitting diode display device according to the first exemplary embodiment by using two scan drivers. Further, another scan method, in which the select scan signals are selectively applied to the plurality of select scan lines, may also be applicable to the organic light emitting diode display device according to the first exemplary embodiment.

Referring back to FIGS. 1 and 2, in the first exemplary embodiment, one sub-pixel $\mathbf{111}_{ij}$ (including the organic light emitting diode $OLED_{R1}$) of the unit pixel $\mathbf{110}_{ij}$ is arranged on the upper side of the select scan line $S_i$, and the other sub-pixel $\mathbf{112}_{ij}$ (including the organic light emitting diode $OLED_{R2}$) of the unit pixel $\mathbf{110}_{ij}$ is arranged on the lower side of the select scan line $S_i$. Alternatively, as shown in FIG. 4, the two sub-pixels $\mathbf{111}_{ij}$ and $\mathbf{112}_{ij}$ may be arranged on the lower side (or the upper side) of the select scan line $S_i$.

Figure 4:
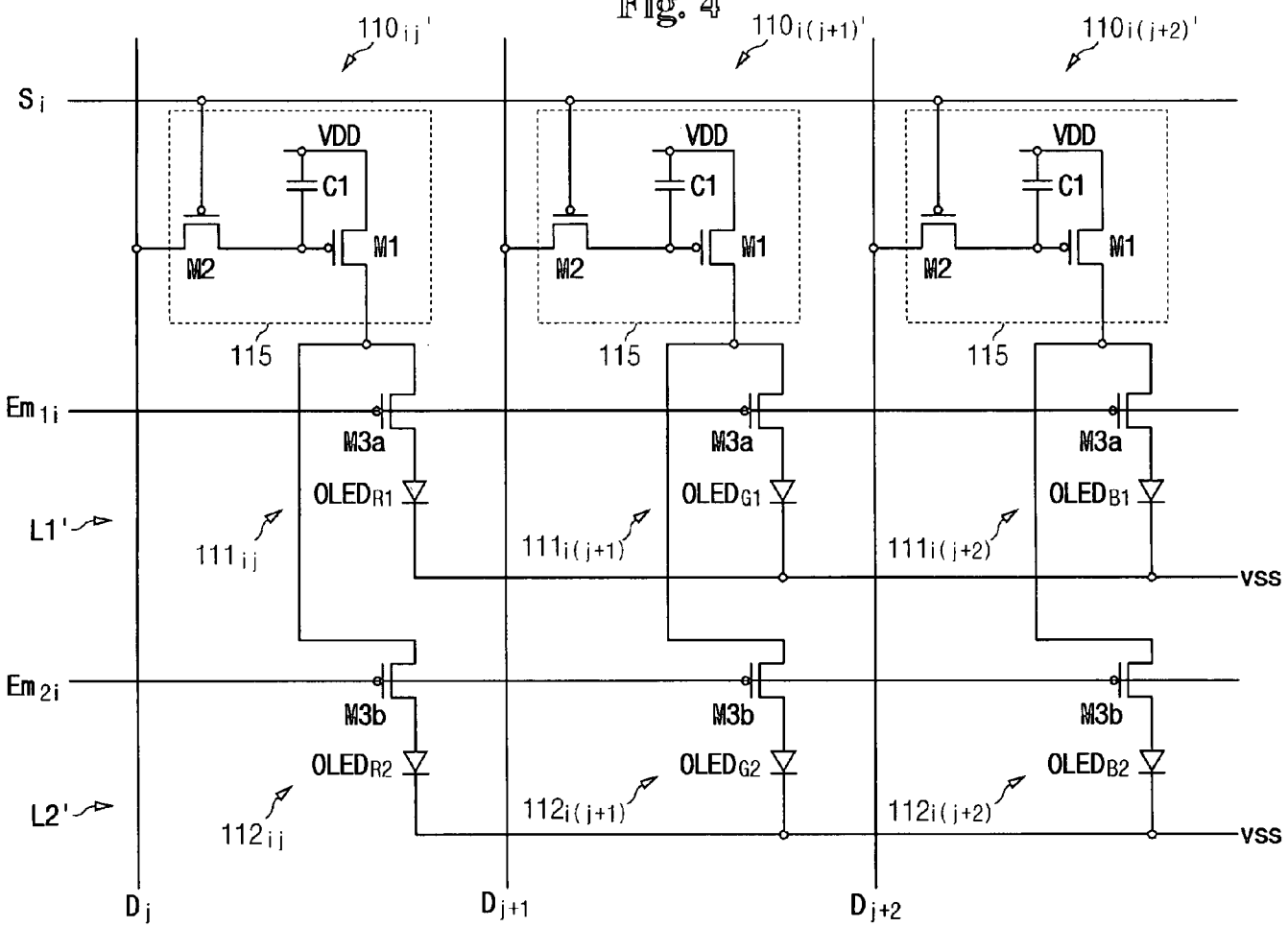
FIGS. 4 to 6 respectively show simplified circuit diagrams of unit pixels of organic light emitting diode display devices according to second to fourth exemplary embodiments of the present invention.

FIG. 4 shows a simplified circuit diagram of unit pixels $\mathbf{110}_{ij}'$, $\mathbf{110}_{i(j+1)}'$ and $\mathbf{110}_{i(j+2)}'$ of an organic light emitting diode display device according to a second exemplary embodiment of the present invention.

As shown in FIG. 4, the organic light emitting diodes $OLED_{R1}$, $OLED_{G1}$ and $OLED_{B1}$ are arranged below the pixel driver 115 to form the upper line L1', and the organic light emitting diodes $OLED_{R2}$, $OLED_{G2}$ and $OLED_{B2}$ are arranged below the upper line L1' to form the lower line L2'.

However, when the organic light emitting diodes are arranged as shown in FIG. 4, length of a wire for transmitting current from the pixel driver 115 to the organic light emitting diode $OLED_{R2}$, $OLED_{G2}$ or $OLED_{B2}$ is longer than length of a wire for transmitting current from the pixel driver 115 to the organic light emitting diode $OLED_{R1}$, $OLED_{G1}$ or $OLED_{B1}$. Then, the brightness of the upper line L1' may be different from the brightness of the lower line L2' by parasitic components present in the wire.

The transistors M1, M2, M3*a*, and M3*b* are depicted as PMOS transistors in FIGS. 2 and 4, but another conductive type of transistors may be applicable to the transistors M1, M2, M3*a*, and M3*b*.

Figure 5:
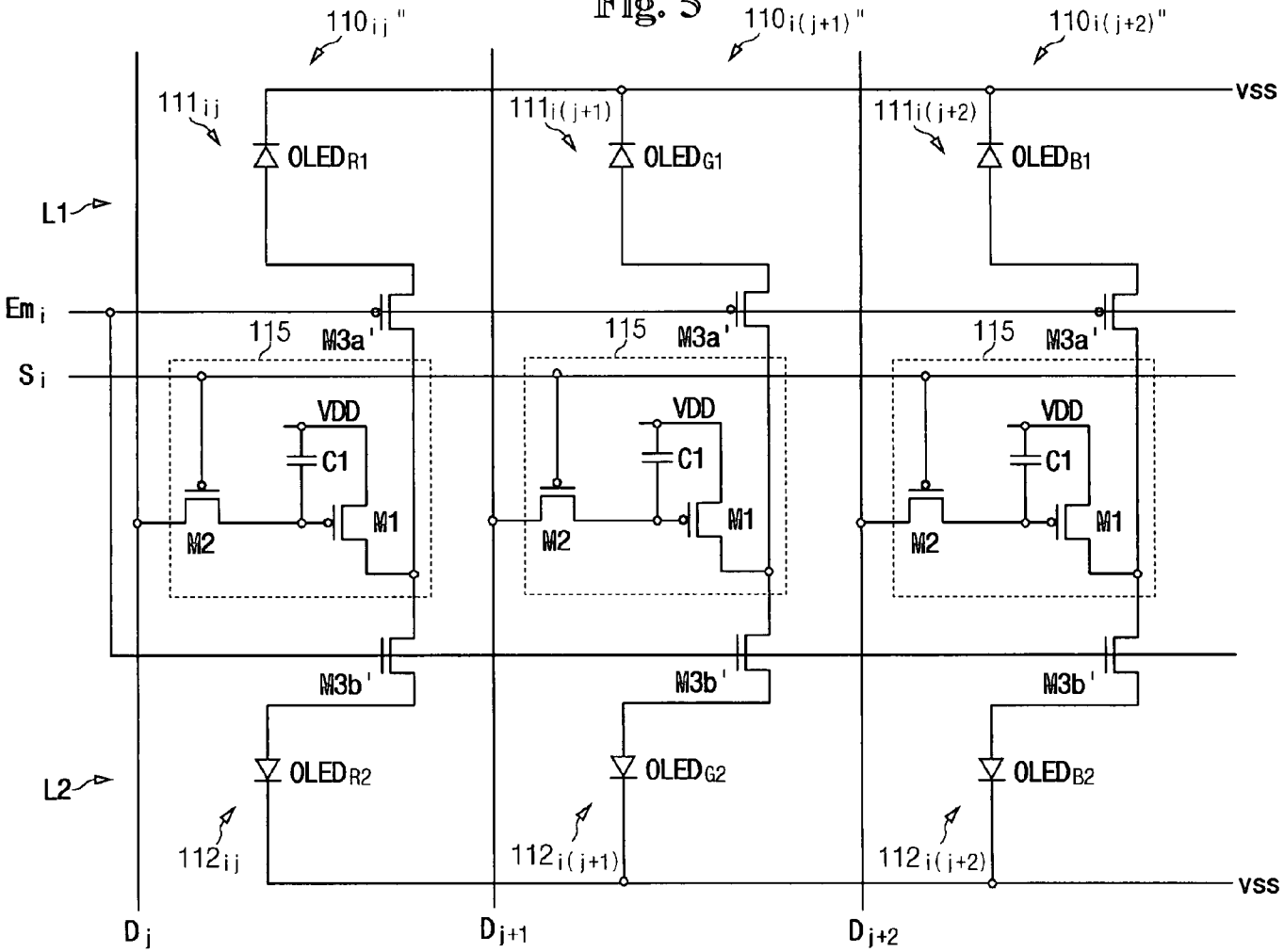

In addition, while the two emission control transistors M3*a* and M3*b* are respectively controlled by the two emit scan lines $Em_{1i}$ and $Em_{2i}$ in the first and second exemplary embodiments, emission control transistors in other embodiments may be controlled by one emit scan line as shown in FIG. 5.

FIG. 5 shows a simplified circuit diagram of unit pixels $\mathbf{110}_{ij}$", $\mathbf{110}_{i(j+1)}$" and $\mathbf{110}_{i(j+2)}$" of an organic light emitting diode display device according to a third exemplary embodiment of the present invention.

As shown in FIG. 5, the unit pixel $\mathbf{110}_{ij}$" according to the third exemplary embodiment has the same structure as that according to the first exemplary embodiment, except for emission control transistors M3*a*' and M3*b*' and an emit scan line $Em_i$.

In more detail, an emission control transistor M3*a*' has the opposite conductive type to an emission control transistor M3*b*', and the emit scan line $Em_i$ on $i^{th}$ row is coupled to gates of the two emission control transistors M3*a*' and M3*b*'. In FIG. 5, the emission control transistors M3*a*' respectively coupled to the organic light emitting diodes $OLED_{R1}$, $OLED_{G1}$ and $OLED_{B1}$ of the upper line L1 are depicted as PMOS transistors, and the emission control transistors M3*b*' coupled to the organic light emitting diodes $OLED_{R2}$, $OLED_{G2}$ and $OLED_{B2}$ of the lower line L2 are depicted as NMOS transistors. In addition, an emission control signal applied to the emit scan line $Em_i$ has the same signal timing as the emission control signal emit1[*i*] shown in FIG. 3.

Then, emission timings of the organic light emitting diodes $OLED_{R1}$, $OLED_{G1}$ and $OLED_{B1}$ coupled to the transistors M3*a*', which have the same conductive type as the transistors M3*a* shown in FIG. 2, are the same as those of the first exemplary embodiment. Referring to FIG. 3, since the emission control signal emit2[*i*] has an inverted waveform of the emission control signal emit1[*i*], and the transistor M3*b*' has the opposite conductive type to the transistor M3*b* shown in FIG. 2, emission timings of the organic light emitting diodes $OLED_{R2}$, $OLED_{G2}$ and $OLED_{B2}$ coupled to the transistors M3*b*' are the same as those of the first exemplary embodiment.

As a result, the number of the emit scan lines $Em_i$ according to the third exemplary embodiment can be reduced as compared with those according to the first and second exemplary embodiments.

The two sub-pixels share the select scan line in the first to third exemplary embodiments, but three or more sub-pixels may share the select scan line in other embodiments. Assuming that three sub-pixels (respectively including three organic light emitting diodes) arranged in a column direction share a select scan line, three emission control transistors are coupled to the three organic light emitting diodes, respectively. The three emit scan lines may be respectively coupled to gates of the three emission control transistors, and may respectively transmit (or apply) emission control signals for controlling the three emission control transistors. In addition, one field may be divided into three subfields, and the three emission control transistors may be respectively turned on in the three subfields. Then, one row may be divided into the three lines, and the three lines may emit light in the three subfields, respectively.

The sub-pixels having the same color are coupled to the pixel driver 115 in the first to third exemplary embodiment, but the sub-pixels having different colors may be coupled to the pixel driver 115. For example, R organic light emitting diode may be coupled to the upper side of the pixel driver 115 in the unit pixel $\mathbf{110}_{ij}$ shown in FIG. 2, and G organic light emitting diode may be coupled to the lower side of the pixel driver 115.

However, since the R, G, and B organic light emitting diodes generally require different current ranges for representing gray levels, the driving voltages which are respectively transmitted from the driving transistors to the R, G, and B organic light emitting diodes are set to the different ranges. In order to set the different ranges, the ranges of the data voltages which are transmitted through the data lines to the driving transistors may be set to be different in R, G, and B sub-pixels, or the sizes of the driving transistors may be set to be different in the R, G, and B sub-pixels. However, if the colors represented in the sub-pixels sharing the pixel driver are different, the data voltages corresponding to the sub-pixels having the different colors are respectively transmitted to the data line in the respective subfields. Then, the data voltage of the data driver is difficult to be optimized because the data voltage range of the data driver is not optimized to the sub-pixels having the same color and is optimized to or made suitable for the sub-pixels having different colors.

On the other hand, when the sub-pixels sharing the pixel driver have the same color as shown in FIGS. 2, 4, and 5, each output of the data driver can be optimized to the data voltage corresponding to each color. Accordingly, the data voltage transmitted to the one data line can be set to the voltage range corresponding to the one color, and the desired brightness can be represented in the respective sub-pixels. As a result, a white balance can be realized in the display area.

In addition, the pixel driver using the switching and driving transistors and the capacitor is described in the first to third exemplary embodiments, but the plurality of sub-pixels may share a pixel driver which uses at least one transistor and/or at least one capacitor in addition to the switching and driving transistors to compensate variation of the threshold voltage of the driving transistor or the voltage drop. That is, since the driving current outputted from the pixel driver generally depends on the threshold voltage of the driving transistor in the unit pixel shown in FIG. 2, the driving currents may be different if the threshold voltages of the driving transistors are different. Then, the brightness between the unit pixels may be different. A unit pixel which can compensate for a variation of the threshold voltage of the driving transistor will be described with reference to FIG. 6.

Figure 6:
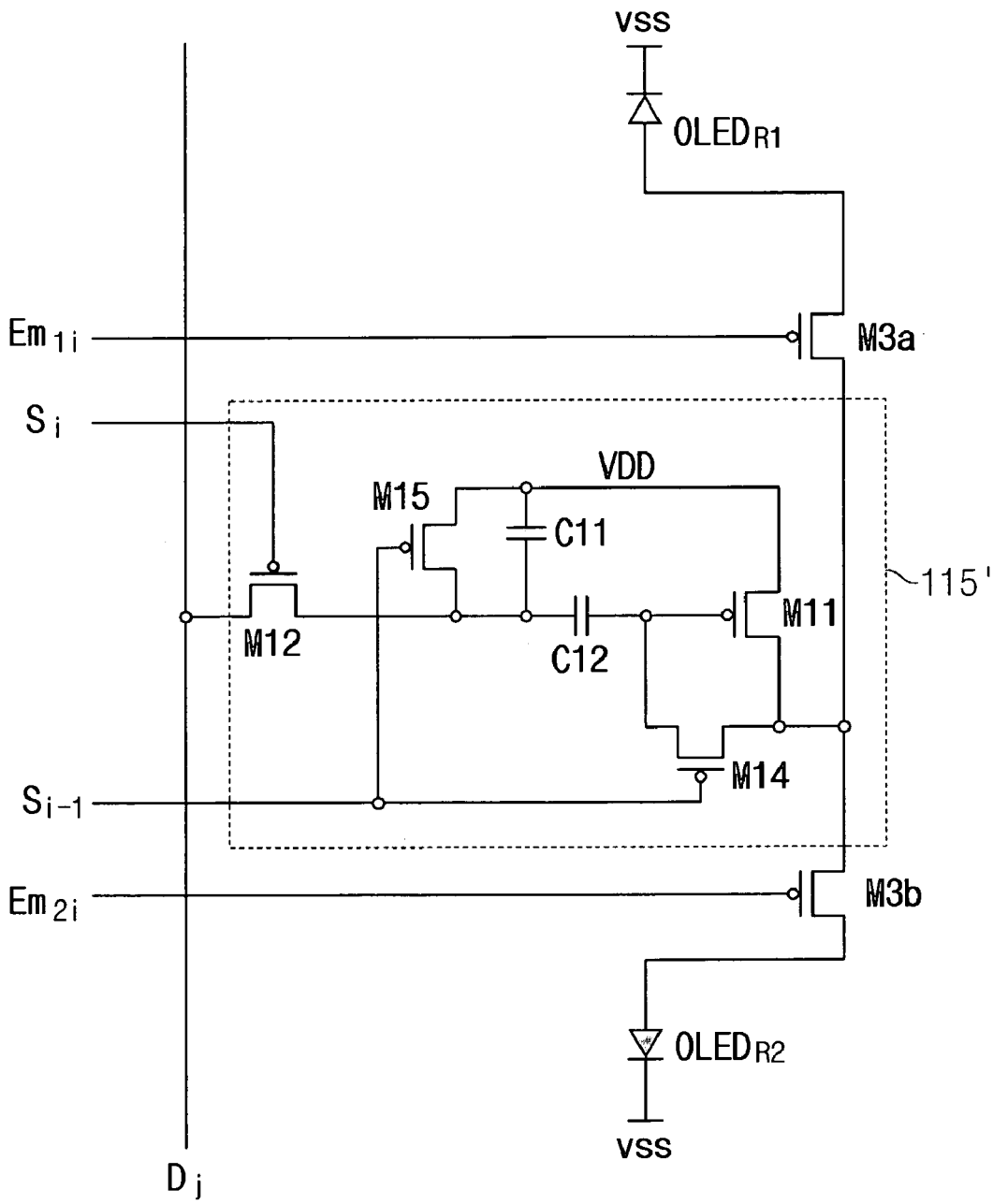

FIG. 6 shows a simplified circuit diagram of a unit pixel of an organic light emitting diode display device according to a fourth exemplary embodiment of the present invention. The unit pixel coupled to the scan line $S_i$ of the $i^{th}$ row and the data line $D_j$ will be exemplified in FIG. 6. When referring to the select scan lines, a scan line for transmitting a current select signal will be referred to as a "current select scan line" and a scan line which has transmitted a select signal before the current select signal is transmitted will be referred to as a "previous select scan line."

As shown in FIG. 6, a pixel driver 115' of the unit pixel according to the fourth exemplary embodiment further includes a threshold voltage compensator for compensating a threshold voltage of a driving transistor. Hence, the unit pixel of FIG. 6 is different from the unit pixel according to the first exemplary embodiment. The threshold voltage compensator includes two transistors M14 and M15, and a capacitor C12.

In more detail, transistors M11, M12, M13*a*, and M13*b* correspond to the transistors M1, M2, M3*a*, and M3*b* shown in FIG. 2, respectively, and capacitors C11 and C12 correspond to the capacitor C1 shown in FIG. 2. A first electrode of the capacitor C11 is coupled to a power supply voltage VDD, and a second electrode of the capacitor C11 is coupled to a first electrode of the capacitor C12. A second electrode of the capacitor C12 is coupled to a gate electrode of the driving transistor M11, and the switching transistor M12 is coupled to the first electrode of the capacitor C12. The transistor M14 is coupled between gate and drain electrodes of the transistor M11, and diode-connects the transistor M11 in response to the select signal of the previous select scan line $S_{i-1}$. The transistor M15 is coupled between the power supply voltage VDD and the first electrode of the capacitor C12, and couples the first electrode of the capacitor C12 to the power supply voltage VDD in response to the select signal of the previous select scan line $S_{i-1}$.

An operation of the unit pixel $\mathbf{115}_{ij}$' shown in FIG. 6 will be described with reference to FIG. 7. In reference to FIG. 7, a first subfield in which the organic light emitting diodes formed on the upper line L1 are emitted by turn-on of the transistors M13*a* will be described only. Therefore, the emission control signal, which is applied to the emit scan line $Em_{2i}$ and is high-level in the first subfield, is not shown in FIG. 7.

Figure 7:
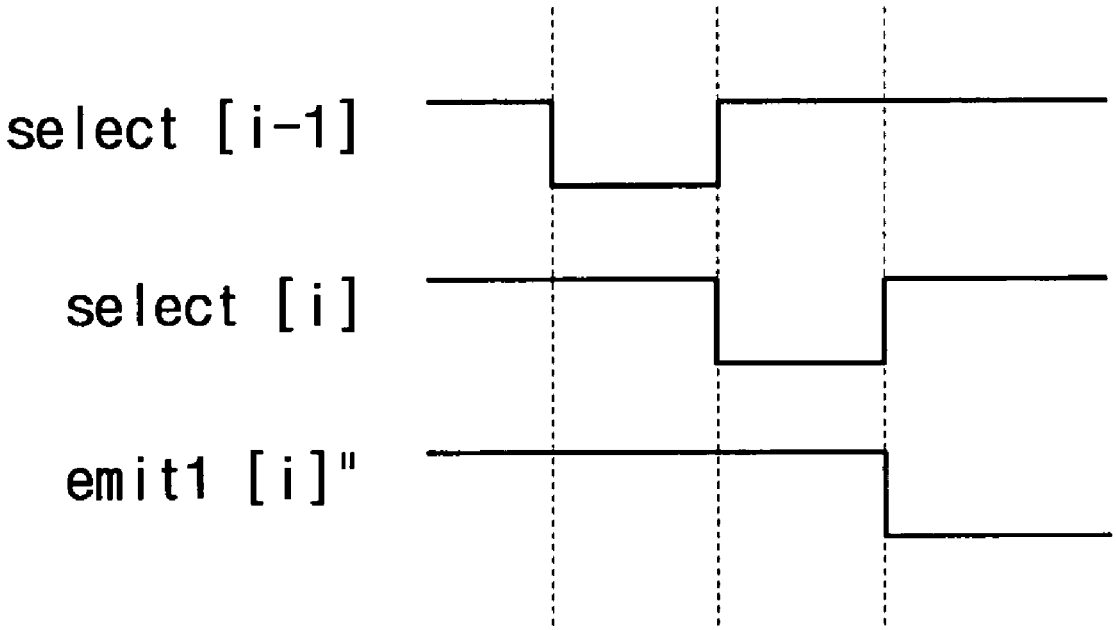
FIG. 7 shows a signal timing diagram in the unit pixel of FIG. 6.

Referring to FIG. 7, the transistors M14 and M15 are turned on during a period in which the select signal select[i−1] of the previous select scan line $S_{i-1}$, is low-level, and the emission control signal emit1[*i*]" of the emit scan line $Em_{1i}$ is high-level. Then, the transistor M14 is diode-connected while the transistor M13*a* and M13*b* are turned off, and a voltage between the gate and source-electrodes of the transistor M11 becomes the threshold voltage Vth of the transistor M11. In addition, since the capacitor C12 is coupled between the gate and source electrodes of the transistor M11, a voltage at the gate electrode of the transistor M11, i.e., the second electrode of the capacitor C12, becomes "VDD+Vth" voltage.

Next, the transistor M12 is turned on and the transistors M14 and M15 are turned off during a period in which the select signal select[i] of the current select scan line $S_i$ is low-level, and the emit control signal emit1[*i*]" is high-level. Then, since the data voltage Vdata is applied to the first electrode of the capacitor C12 through the switching transistor M12, a voltage at the second electrode of the capacitor C12 is changed by the variation "Vdata−VDD" of the voltage at the first electrode of the capacitor C12. That is, the voltage at the second electrode of the capacitor C12 becomes "Vdata+Vth" voltage, and therefore, the voltage between the gate and source electrodes of the transistor M11 becomes "Vdata+Vth−VDD" voltage. In addition, the "Vdata+Vth−VDD" voltage is stored in the capacitors C11 and C12.

Next, when the emission control signal becomes low-level, a current $I_{OLED}$ expressed in Equation 2 flows from the transistor M11 to the organic light emitting diode $OLED_{R1}$, and then, the organic light emitting diode $OLED_{R1}$ emits light.

$$I_{OLED} = \frac{\beta}{2}(VDD - Vdata)^2 \qquad \text{Equation 2}$$

In addition, a unit pixel which can compensate the threshold voltage of the driving transistor by adding at least one transistor and/or at least one capacitor to the unit pixel of FIG. 2 may be used instead of the unit pixel shown in FIG. 6.

Further, the low-level period of the emission control signal may be set differently from the period shown in FIG. 3. For example, when the brightness is high, the low-level period of the emission control signal may be set to be shorter than a period corresponding to the subfield. That is, the rising edge of the emission control signal may be set to be later than the rising edge of the select signal, and/or the falling edge of the emission control signal may be set to be faster (or earlier) than the rising edge of the select signal in the next subfield.

The organic light emitting diode display device using the voltage programming method is described in the first to fourth exemplary embodiments, but the above-described exemplary embodiments can be applicable to the organic light emitting diode display device using the current programming method.

Next, scan drivers (e.g., the scan driver 200 of FIG. 1) of organic light emitting diode display devices according to exemplary embodiments of the present invention will be described with reference to FIGS. 8 to 25.

Figure 8:
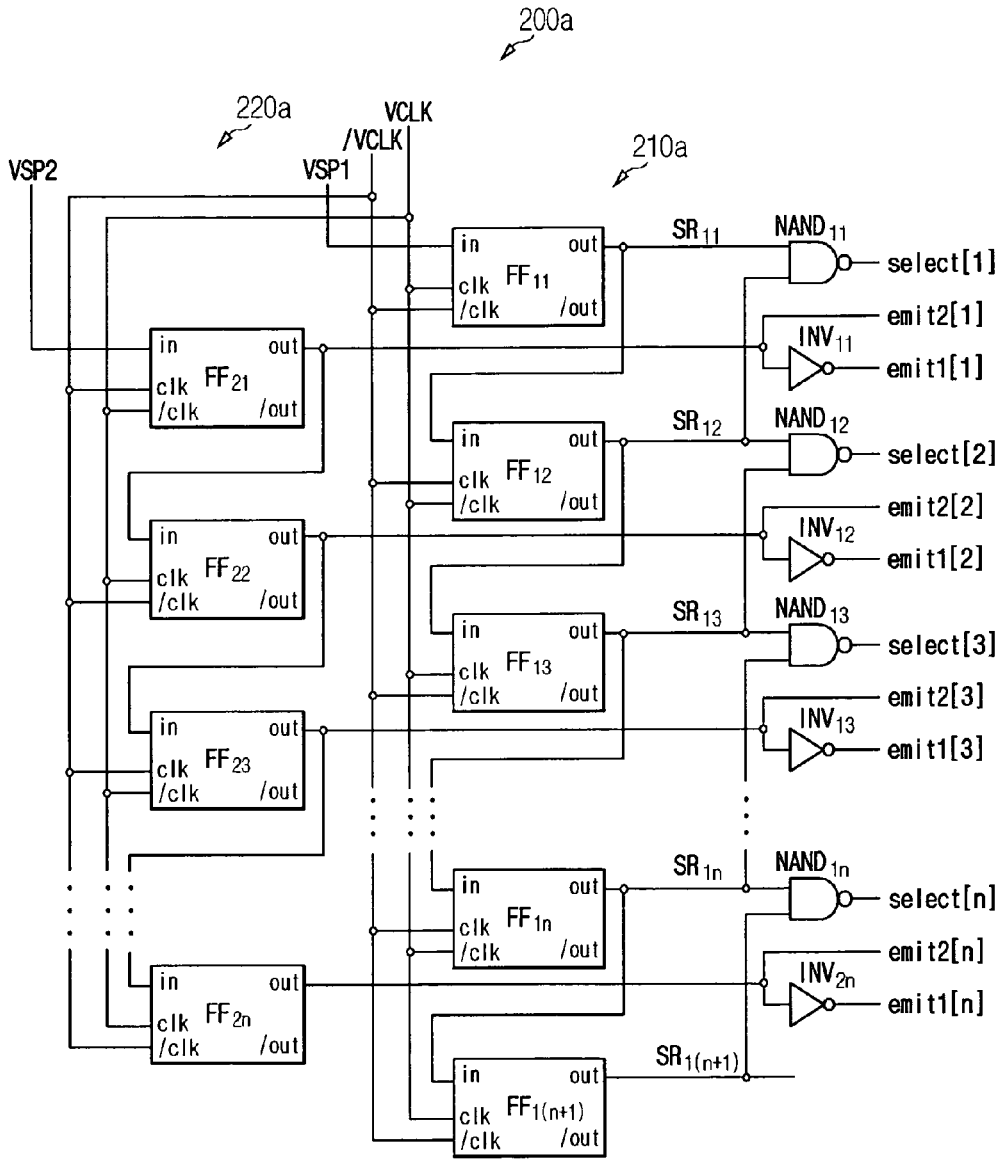
FIGS. 8, 11, 13, 15, 17, 19, 21, 23, 24, 26 and 27 respectively show scan drivers in organic light emitting diode display devices according to fifth to fifteenth exemplary embodiments.
Figure 9:
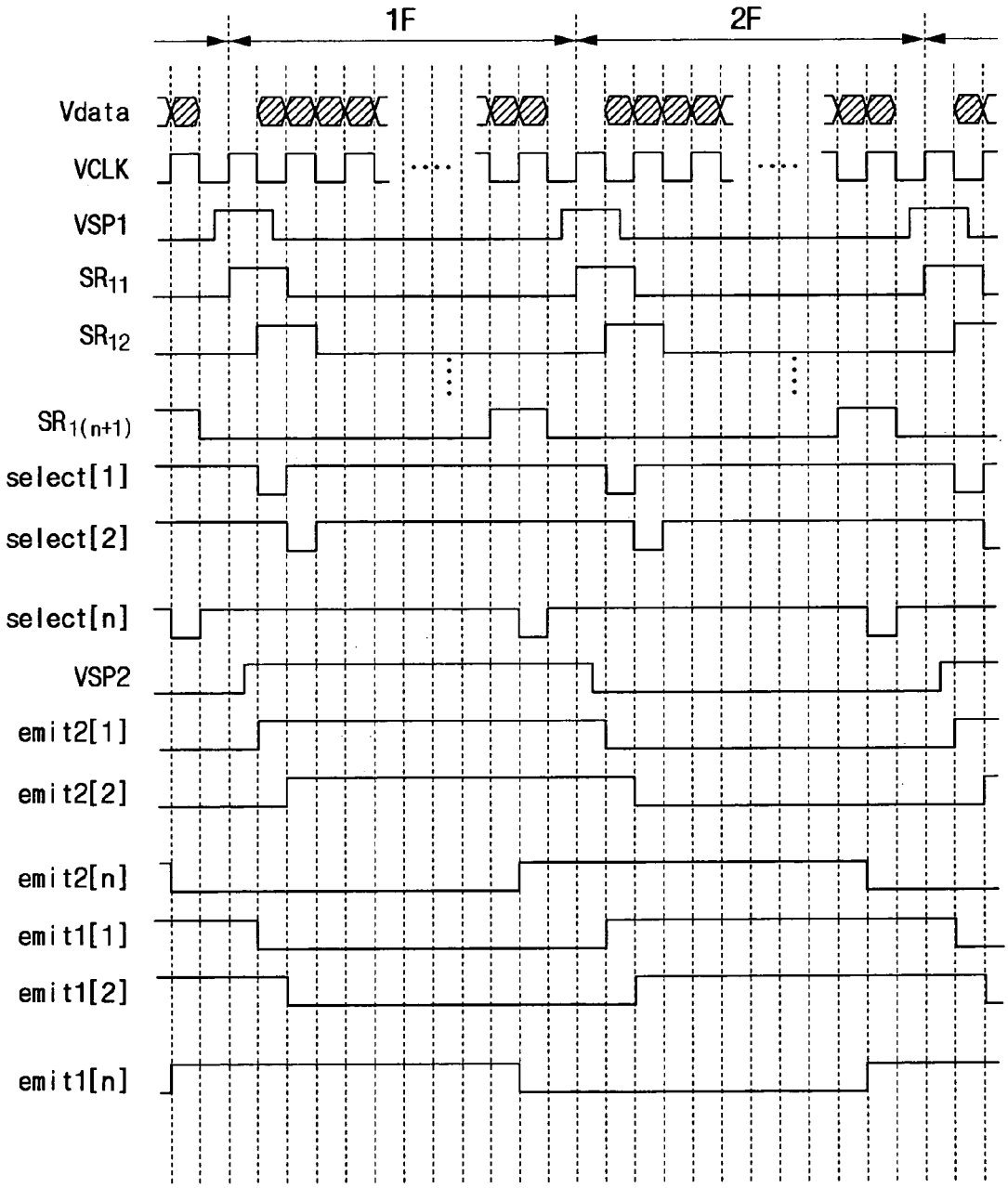
FIGS. 9, 12, 14, 16, 18, 20, 22, 25, 28 respectively show signal timing diagrams in the scan drivers of FIGS. 8, 11, 13, 15, 17, 19, 21, 24, 26.
Figure 10:
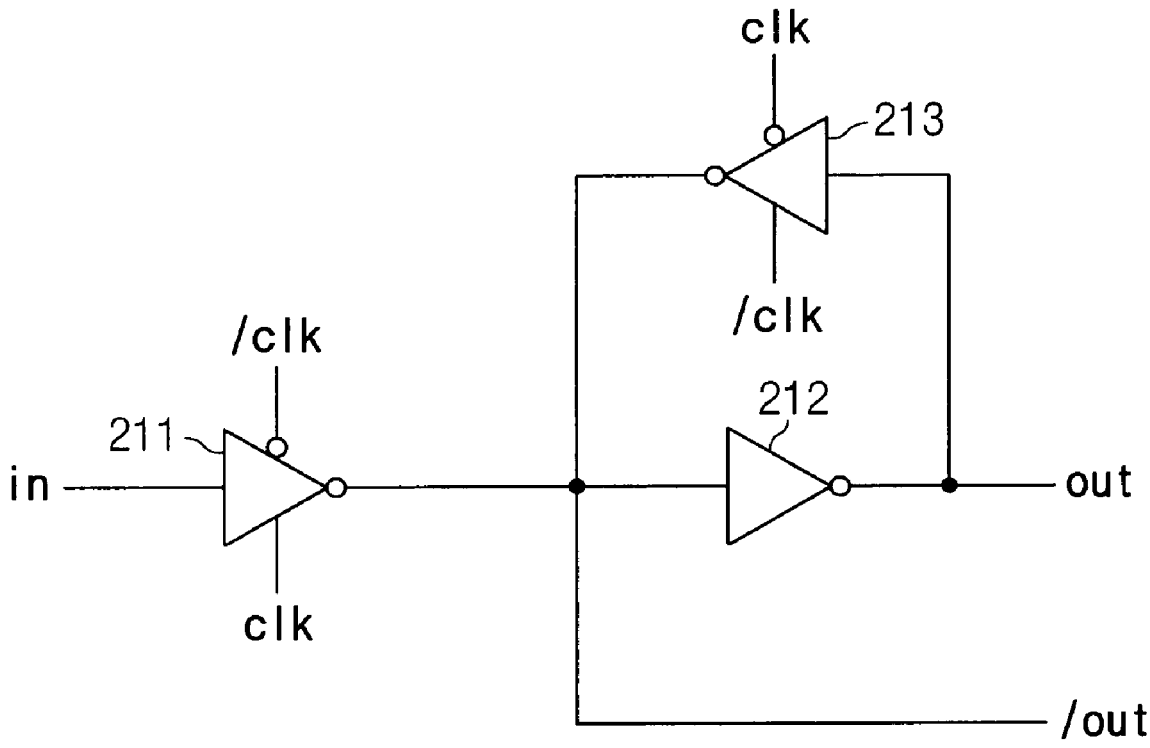
FIG. 10 shows a flip-flop used in a select scan driver of FIG. 8.

FIG. 8 shows a scan driver 200*a* in an organic light emitting diode display device according to a fifth exemplary embodiment, FIG. 9 shows a signal timing diagram in the scan driver 200*a* of FIG. 8, and FIG. 10 shows a flip-flop used in the select scan driver 200*a* of FIG. 8. An inverted signal of a clock VCLK is depicted as /VCLK in FIG. 8, and is not shown in FIG. 9.

As shown in FIG. 8, the scan driver 200*a* includes two shift registers 210*a* and 220*a*. The shift register 210*a* includes (n+1) flip-flops $FF_{11}$ to $FF_{1(n+1)}$ and n NAND gates $NAND_{11}$ to $NAND_{1n}$, and the shift register 220*a* includes n flip-flops $FF_{21}$ to $FF_{2n}$ and n inverters $INV_{21}$ to $INV_{2n}$.

In the shift register 210*a*, a start signal VSP1 is inputted to the first flip-flop $FF_{11}$, and an output signal $SR_{1i}$ of the $i^{th}$ flip-flop $FF_{1i}$ is inputted to the $(i+1)^{th}$ flip-flop $FF_{1(i+1)}$. The $i^{th}$ NAND gate $NAND_{1i}$ performs a NAND operation to the output signals $SR_{1i}$ and $SR_{1(i+1)}$ of the two adjacent flip-flops $FF_{1i}$ and $FF_{1(i+1)}$ and outputs a select signal select[i].

In the shift register 220*a*, a start signal VSP2 is inputted to the first flip-flop $FF_{21}$, and an output signal of the $i^{th}$ flip-flop $FF_{2i}$ is inputted to the $(i+1)^{th}$ flip-flop $FF_{2(i+1)}$. In addition, the output signal of the $i^{th}$ flip-flop $FF_{2i}$ is the emission control signal emit2[*i*], and the inverter $INV_{2i}$ inverts the output signal of the $i^{th}$ flip-flop $FF_{2i}$ to output the emission control signal emit1[*i*].

The flip-flops $FF_{1i}$ and $FF_{2i}$ output input signals (in) in response to a high-level clock (clk), and latch and output the input signals (in) of the high-level period of the clock (clk) in response to a low-level clock (clk). That is, the flip-flops $F_{1i}$ and $FF_{2i}$ output the input signals (in) of the high-level period of the inner clock (clk) during one clock VCLK cycle.

Referring to FIG. 8, the clock /VCLK or VCLK inverted to the clock VCLK or /VCLK, which are used in the flip-flop $FF_{1i}$, are used in the flip-flops $FF_{1(i+1)}$ adjacent to the flip-flop $FF_{1i}$. In more detail, the flip-flops $FF_{1i}$ that are located at odd-numbered positions in a longitudinal direction use the clocks VCLK as inner clocks (clk). The flip-flops $FF_{1i}$ that are located at even-numbered positions in the longitudinal direction use the inverted clocks /VCLK as inner clocks (clk). Since the output signal $SR_{1i}$ of the flip-flop $FF_{1i}$ is inputted to the flip-flop $FF_{1(i+1)}$, the output signal $SR_{1(i+1)}$ of the flip-flop $FF_{1(i+1)}$ is shifted from the output signal $SR_{1i}$ of the flip-flop $FF_{1i}$ by a half clock VCLK cycle.

As shown in FIG. 9, the start signal VSP1 has a high-level signal (e.g., high-level pulse) in the high-level period of the one clock VCLK cycle in each of the subfields 1F and 2F, and the flip-flop $FF_{11}$ outputs the high-level signal during one clock VCLK cycle in each of the subfields 1F and 2F. As a result, the flip-flops $FF_{11}$ to $FF_{1(n+1)}$ may sequentially output each output signal $SR_{1i}$ by shifting the high-level signal by the half clock VCLK cycle.

The NAND gate $NAND_{1i}$ performs a NAND operation of the output signals $SR_{1i}$ and $SR_{1(i+1)}$ of the flip-flops $FF_{1i}$ and $FF_{1(i+1)}$, and outputs a low-level signal (e.g., low-level pulse) when both output signals $SR_{1i}$ and $SR_{1(i+1)}$ are high-level. Here, since the output signal $SR_{1(i+1)}$ of the flip-flop $FF_{1(i+1)}$ is shifted from the output signal $SR_{1i}$ of the flip-flop $FF_{1i}$ by the half clock VCLK cycle, the output signal select[i] of the NAND gate $NAND_{1i}$ has a low-level signal during a period in which the both output signals $SR_{1i}$ and $SR_{1(i+1)}$ have the high-level signal in common in each of the subfields 1F and 2F. In addition, the output signal select[i+1] of the NAND gate $NAND_{1(i+1)}$ is shifted from the output signal select[i] of the NAND gate $NAND_{1i}$ by half the clock VCLK cycle.

Therefore, the shift register 210*a* may sequentially output each select signal select[i] by shifting the low-level signal by the half clock VCLK cycle.

The flip-flop $FF_{2i}$ of the shift register 220*a* has the same structure as the flip-flop $FF_{1i}$ of the shift register 210*a* except for the clocks VCLK and /VCLK. That is, the flip-flops $FF_{2i}$ that are located at odd-numbered positions in the longitudinal direction use the inverted clocks /VCLK as inner clocks (clk), and the flip-flops $FF_{2i}$ that are located at the even-numbered positions use the clocks VCLK as inner clocks (clk). Therefore, the emission control signal emit1[*i*+1] which is the output signal of the flip-flop $FF_{2(i+}1)$ is shifted from the emission control signal emit1[*i*], which is the output signal of the flip-flop $FF_{2i}$, by the half clock VCLK cycle.

In addition, the start signal VSP2 is high-level in the low-level period of all clock VCLK cycles in the subfield 1F and is low-level in the low-level period of all clock VCLK cycles in the subfield 2F. As a result, the emission control signal emit2[1] becomes high-level when the select signal select[1] becomes low-level in the first subfield 1F, and becomes low-level when the select signal select[1] becomes low-level in the second subfield 2F. Therefore, the shift register 220*a* can sequentially output each emission control signal emit2[*i*], which becomes low-level together with the select signal select[i] in the second subfield 2F, by shifting the half clock VCLK cycle.

Since the output signal emit1[*i*] of the inverter $INV_{2i}$ has an inverted waveform of the emission control signal emit2[*i*], the shift register 220*a* can sequentially output each emission control signal emit1[*i*], which becomes low-level together with the select signal select[i] in the first subfield 1F, by shifting the half clock VCLK cycle.

Since the flip-flops $FF_{1i}$ and the flip-flops $FF_{2i}$ have the same structure, a flip-flop of FIG. 10 can be used to represent both the flip-flops $FF_{1i}$ and the flip-flops $FF_{2i}$. Referring to FIG. 10, the flip-flop (e.g., $FF_{1i}$) includes a clocked inverter 211, and a latch including an inverter 212 and a clocked inverter 213. The clocked inverter 211 inverts an input signal (in) when the clock (clk) is high-level, and the inverter 212 inverts the output signal (/out) of the clocked inverter 211. When the clock (clk) is low-level, the output of the clocked inverter 211 is blocked, the output signal of the inverter 212 is inputted to the clocked inverter 213, and the output signal (/out) of the clocked inverter 213 is inputted to the inverter 212. As a result, the latch is formed. At this time, the output signal (out) of the inverter 212 is the output signal of the flip-flop, and the input signal (/out) of the inverter 212 is the inverted signal to the output signal (out). Therefore, the flip-flop can output the input signal (in) when the clock (clk) is high-level, and latch and output the input signal (in) in the high-level period of the clock (clk) when the clock (clk) is low-level.

As shown in FIG. 10, the signal (/out) inverted to the output signal (out) is outputted from the flip-flop (e.g., $FF_{2i}$) of the shift register 220*a*. Therefore, the inverted output signal (/out) of the flip-flop of FIG. 10 may be used as the emission control signal emit1[*i*] of the first subfield 1F, and the inverter $INV_{2i}$ can be eliminated in the shift register 220*a*. In addition, the signal having the high-level signal in the first subfield 1F is used as the start signal VSP2 in FIGS. 8 and 9, but a signal inverted to the start signal VSP2 may be used as the start signal of the shift register 220*a*. Then, the output signal of the flip-flop becomes the emission control signal emit1[*i*] of the first subfield 1F, and the output signal of the inverter $INV_{2i}$ becomes the emission control signal emit2[*i*] of the second subfield 2F.

As described above, the emission control signal emit1[*i*] or emit2[*i*] is low-level when the select signal select[i] is low-level in the scan driver 200*a*. This signal timing can be applicable to the organic light emitting diode display device using the voltage programming method in which the data voltage is transmitted to the data line to be stored in the capacitor. However, in the organic light emitting diode display device using the current programming method, the current from the driving transistor needs to be blocked from the organic light emitting diodes when the data current are programmed to the pixel driver. That is, emission control signals emit1[*i*]' and emit2[*i*]' should be high-level when the select signal select[i] is low-level. In addition, this signal timing may be applicable to the organic light emitting diode display device using the voltage programming method. These exemplary embodiments will be described with reference to FIGS. 11 and 12.

Figure 11:
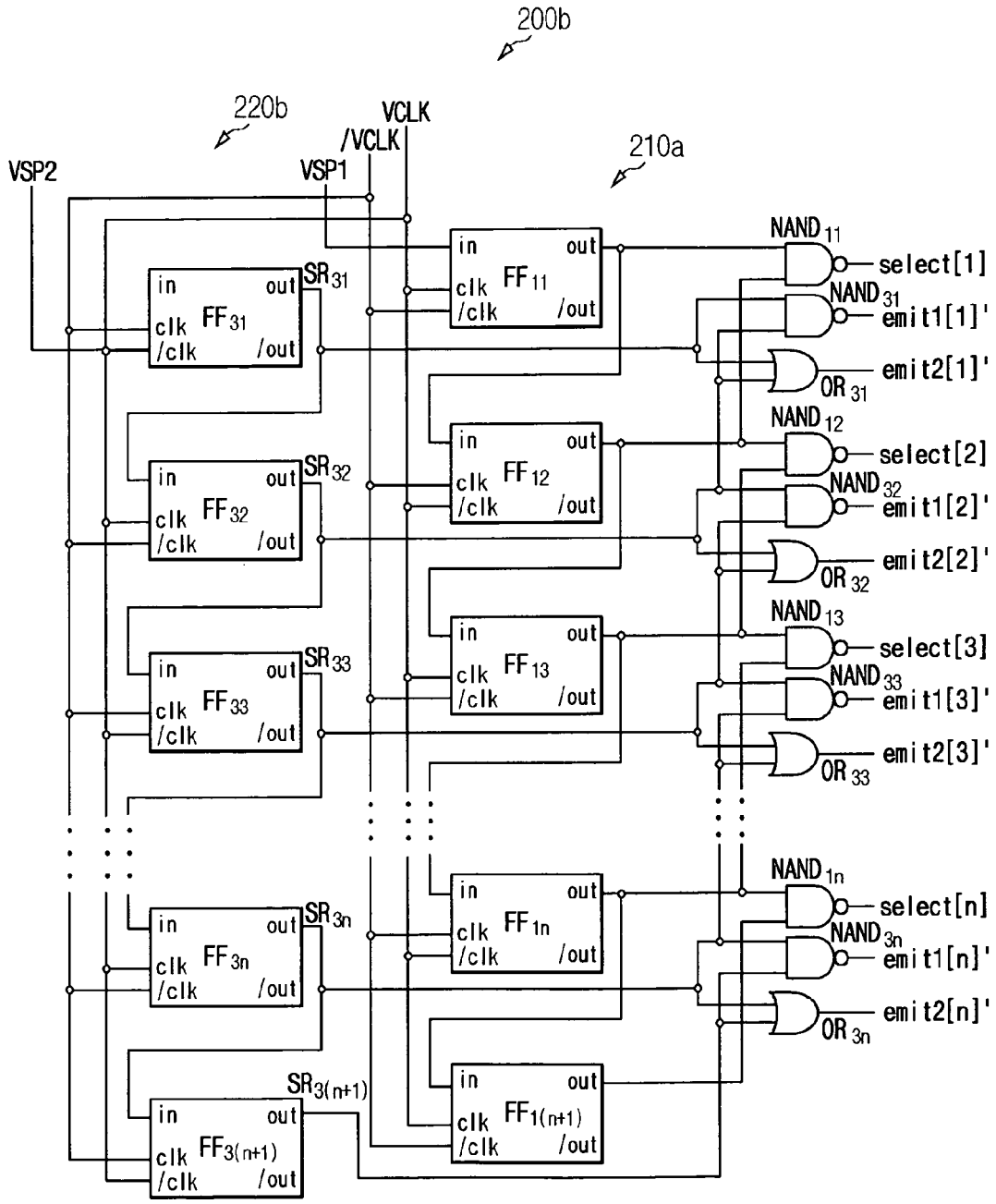
Figure 12:
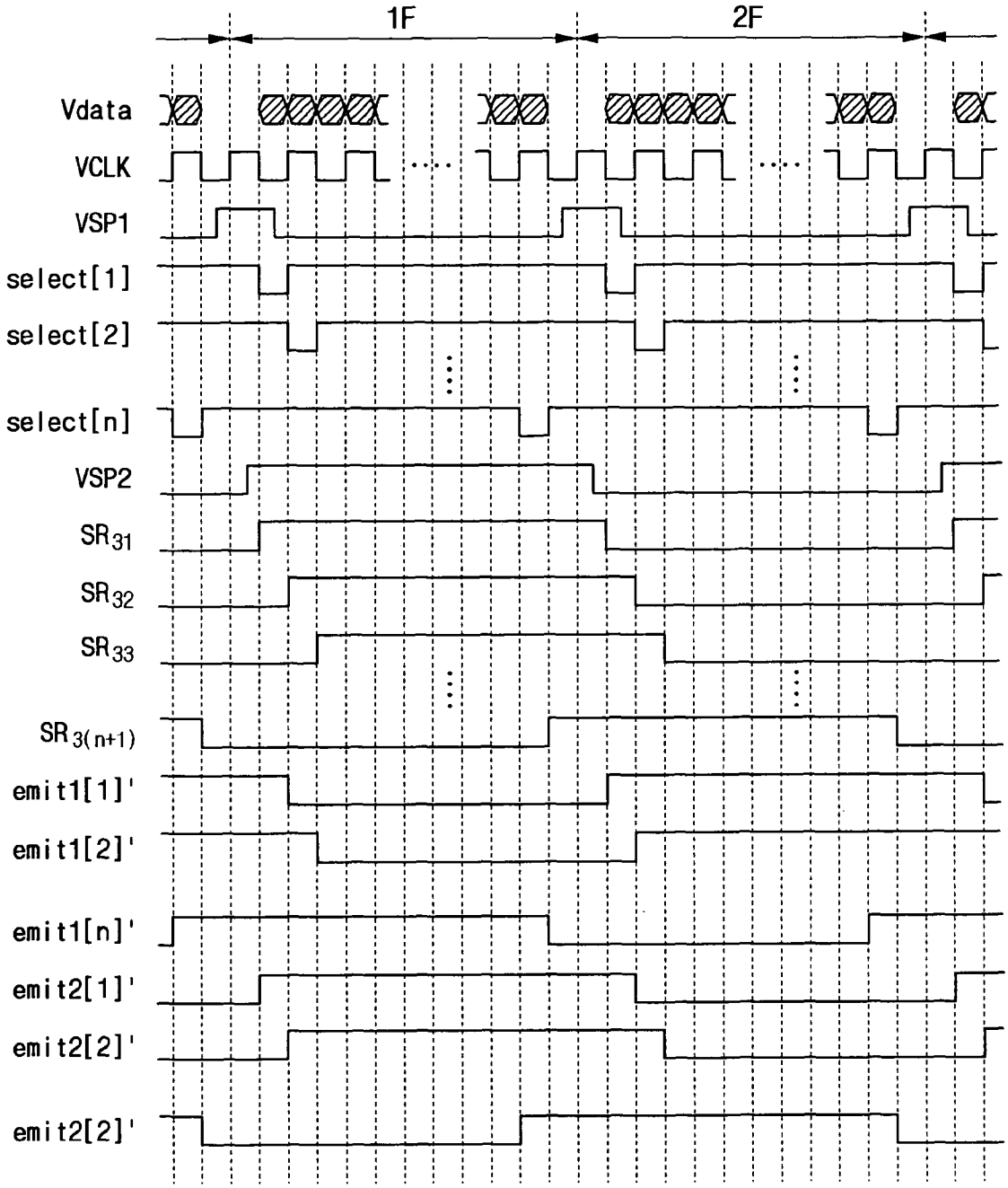

FIG. 11 shows a scan driver 200*b* in an organic light emitting diode display device according to a sixth exemplary embodiment, and FIG. 12 shows a signal timing diagram in the scan driver 200*b* of FIG. 11. The scan driver 200*b* of FIGS. 11 and 12 use the same clock VCLK as the scan driver 200*a* shown in FIGS. 8 and 9.

As shown in FIG. 11, the scan driver 200*b* includes the shift register 210*a* for outputting the select signal select[i] and a shift register 220*b* for outputting the emission control signals emit1[*i*]' and emit2[*i*]'. The shift register 220*b* includes (n+1) flip-flops $FF_{31}$ to $FF_{3(n+1)}$, n NAND gates $NAND_{31}$ to $NAND_{3n}$, and n OR gates $OR_{31}$ to $OR_{3n}$. Here, a NAND gate and an inverter may be used instead of the OR gate $OR_{3i}$.

The clock VCLK is inputted to the flip-flops $FF_{3i}$, and the NAND gate $NAND_{3i}$ performs a NAND operation between the output signals $SR_{3i}$ and $SR_{3(i+1)}$ of the flip-flops $FF_{3i}$ and $FF_{3(i+1)}$ to output the emission control signal emit1[*i*]'. The OR gate $OR_{3i}$ performs an OR operation between the output signals $SR_{3i}$ and $SR_{3(i+1)}$ of the flip-flops $FF_{3i}$ and $FF_{3(i+1)}$ to output the emission control signal emit2[*i*]'.

As shown in FIG. 12, the start signal VSP2 shown in FIG. 9 is inputted to the flip-flop $FF_{3i}$. Therefore, the output signal $SR_{3i}$ of the flip-flop $FF_{3i}$ becomes high-level when the select signal select[i] becomes low-level in the first subfield 1F, and becomes low-level when the select signal select[i] becomes low-level in the second subfield 2F. Since the NAND gate $NAND_{3i}$ outputs the low-level signal while both the output signal $SR_{3i}$ and $SR_{3(i+1)}$ of the flip-flops $FF_{3i}$ and $FF_{3(i+1)}$ are high-level, the emission control signal emit1[*i*]' becomes low-level when the select signal select[i] becomes high-level in the first subfield 1F. In addition, since the OR gate $OR_{3i}$ outputs the high-level signal while both the output signal $SR_{3i}$ and $SR_{3(i+1)}$ of the flip-flops $FF_{3i}$ and $FF_{3(i+1)}$ are low-level, the emission control signal emit2[*i*]' becomes low-level when the select signal select[i] becomes high-level in the second subfield 2F.

As described above, the emission control signals emit1[*i*]' and emit2[*i*]' are high-level in the sixth exemplary embodiment when the select signal select[i] has the low-level signal. In addition, emission control signals emit1[*i*]" and emit2[*i*]" may be high-level when the previous and current select signals select[i−1] and select[i] have the low-level signals. This exemplary embodiment will be described with reference to FIGS. 13 and 14.

Figure 13:
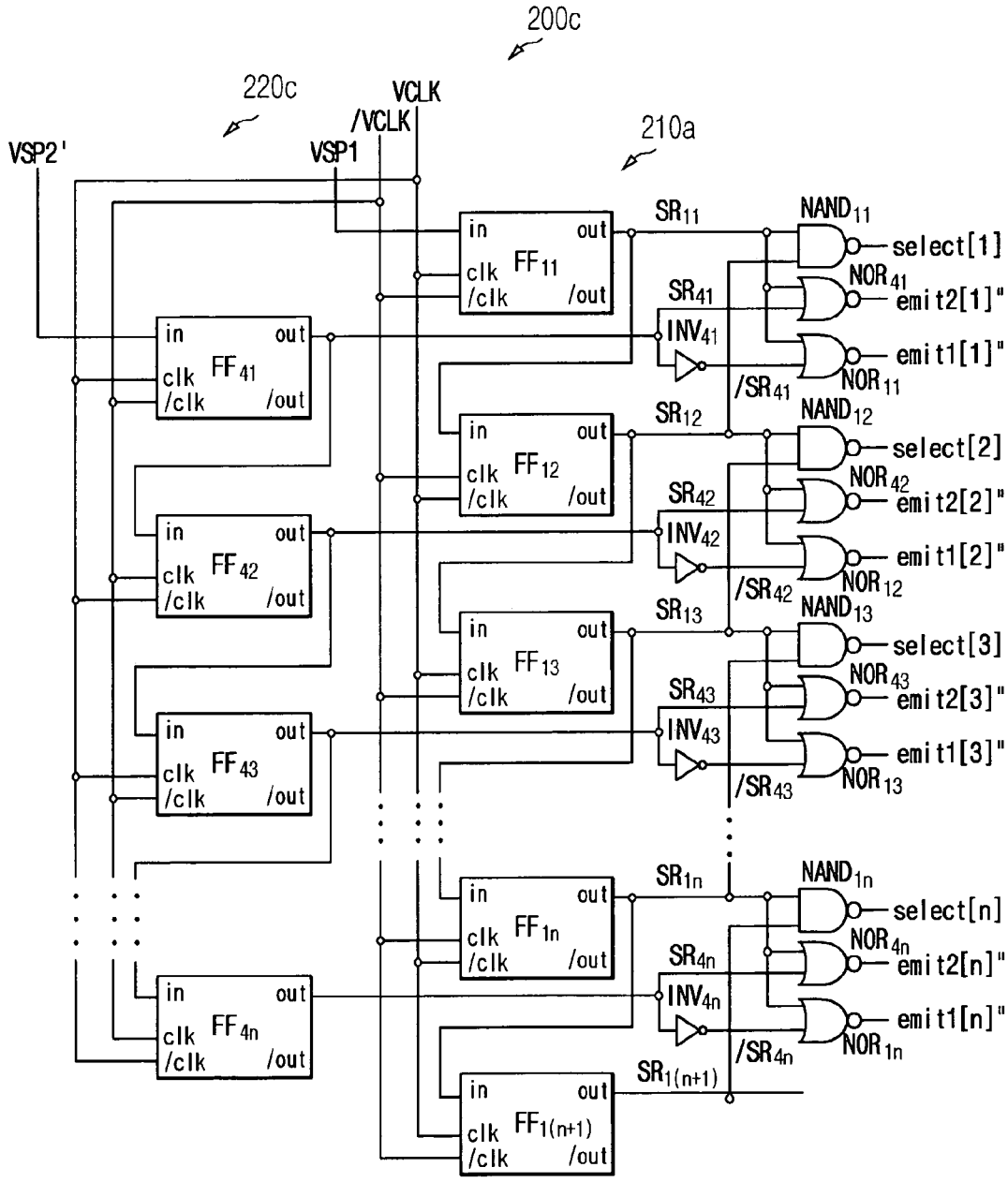
Figure 14:
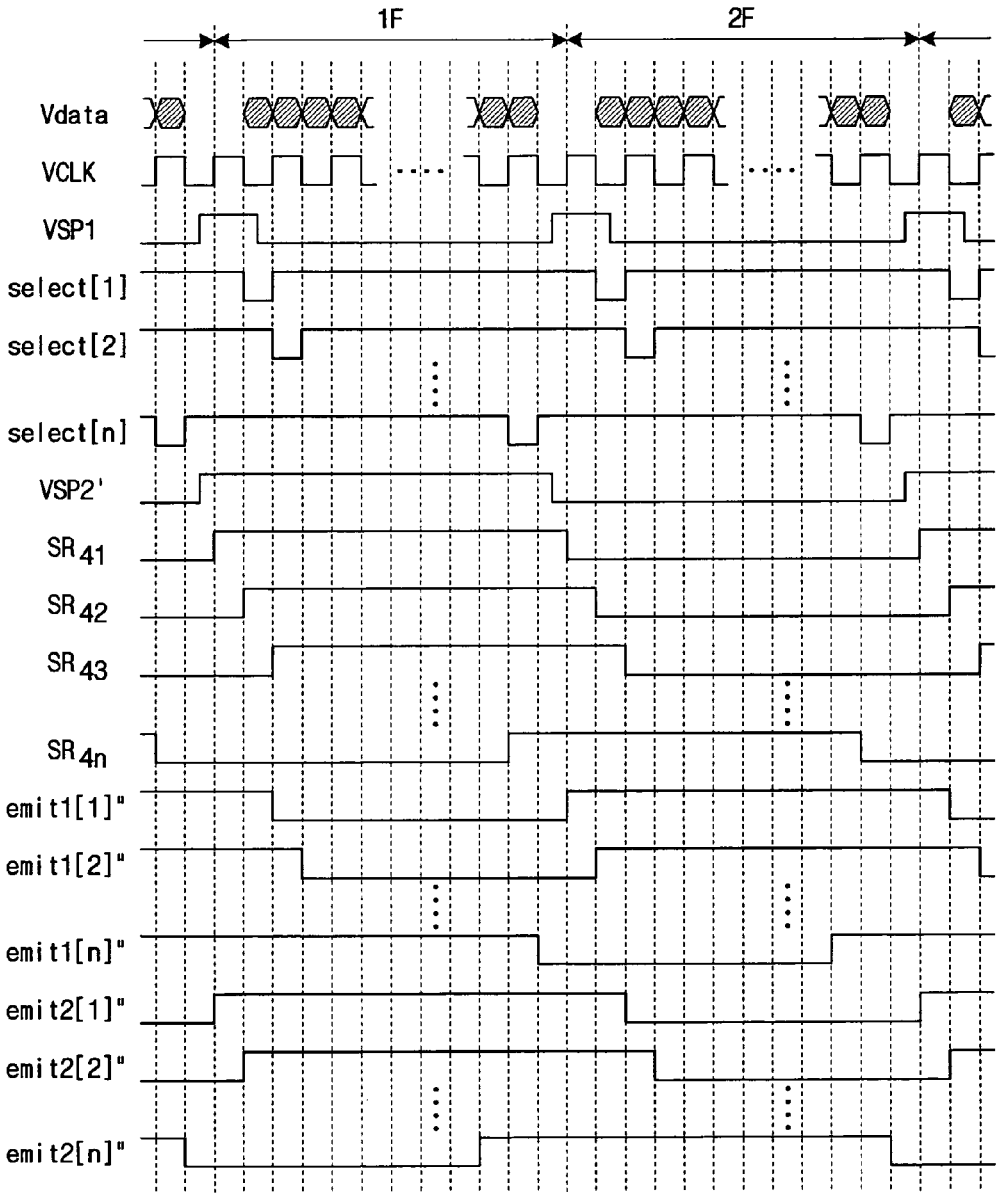

FIG. 13 shows a scan driver 200*c* in an organic light emitting diode display device according to a seventh exemplary embodiment, and FIG. 14 shows a signal timing diagram of the scan driver 200*c* shown in FIG. 13. The scan driver 200*c* of FIGS. 13 and 14 use the same clock VCLK as the scan driver 200*a* shown in FIGS. 8 and 9.

As shown in FIG. 13, the scan driver 200*c* includes the shift register 210*a* for outputting the select signal select[i] and a shift register 220*c* for outputting the emission control signals emit1[*i*]" and emit2[*i*]". The shift register 220*c* includes n flip-flops $FF_{41}$ to $FF_{4n}$, n inverters $INV_{41}$ to $INV_{4n}$, and 2n NOR gates $NOR_{11}$ to $NOR_{1n}$, and $NOR_{41}$ to $NOR_{4n}$.

The flip-flops $FF_{41}$ to $FF_{4n}$ and the inverters $INV_{41}$ to $INV_{4n}$ have the same structure as the flip-flops $FF_{21}$ to $FF_{2n}$ and the inverters $INV_{21}$ to $INV_{2n}$ of FIG. 8 except for the clocks VCLK and /VCLK. That is, the flip-flop $FF_{4i}$ uses the clock VCLK or /VCLK inverted to the clock /VCLK or VCLK of the flip-flop $FF_{2i}$ shown in FIG. 8. The NOR gate $NOR_{1i}$ performs a NOR operation between the output signal $SR_{1i}$ of the flip-flop $FF_{1i}$ and the inverted output signal $/SR_{4i}$ of the flip-flop $FF_{4i}$ to output the emission control signal emit1[*i*]" in the first subfield 1F. The NOR gate $NOR_{4i}$ performs a NOR operation between the output signals $SR_{1i}$ and $SR_{4i}$ of the flip-flops $FF_{1i}$ and $FF_{4i}$ to output the emission control signal emit2[*i*]" in the second subfield 2F.

As shown in FIG. 14, a start signal VSP2' is high-level in the high-level period of the clock VCLK in the first subfield 1F and is low-level in the high-level period of the clock VCLK in the second subfield 2F. As a result, the output signal $SR_{4i}$ of the flip-flop $FF_{4i}$ has the high-level signal during a period corresponding to the first subfield 1F and has the low-level signal during a period corresponding to the second subfield 2F. Therefore, the output signal $SR_{4i}$ of the flip-flop $FF_{4i}$ becomes high-level when the output signal $SR_{1i}$ of the flip-flop $FF_{1i}$ becomes high-level in the first subfield 1F, and becomes low-level when the output signal $SR_{1i}$ of the flip-flop $FF_{1i}$ becomes high-level in the second subfield 2F.

Since the NOR gate $NOR_{1i}$ outputs the low-level signal while both the output signal $SR_{1i}$ of the flip-flop $FF_{1i}$ and the inverted output signal $/SR_{4i}$ of the flip-flop $FF_{4i}$ are low-level, the output signal emit1[*i*]" of the NOR gate $NOR_{1i}$ becomes low-level together with the output signal $SR_{1i}$ in the first subfield 1F and becomes high-level together with the output signal $SR_{1i}$ in the second subfield 2F. Since the NOR gate $NOR_{4i}$ outputs the low-level signal while both the output signals $SR_{1i}$ and $SR_{4i}$ of the flip-flops $FF_{1i}$ and $FF_{4i}$ are low-level, the output signal emit2[*i*]" of the NOR gate $NOR_{4i}$ becomes low-level together with the output signal $SR_{1i}$ in the second subfield 2F and becomes high-level together with the output signal $SR_{4i}$ in the first subfield 1F. Therefore, the emission control signals emit1[*i*]" and emit2[*i*]" are high-level when the previous and current select signals select[i−1] and select[i] have the low-level signals.

In addition, the emission control signals emit1[*i*]" and emit2[*i*]" shown in FIG. 14 may be generated from the scan driver shown in FIG. 11. This exemplary embodiment will be described with reference to FIGS. 15 and 16.

Figure 15:
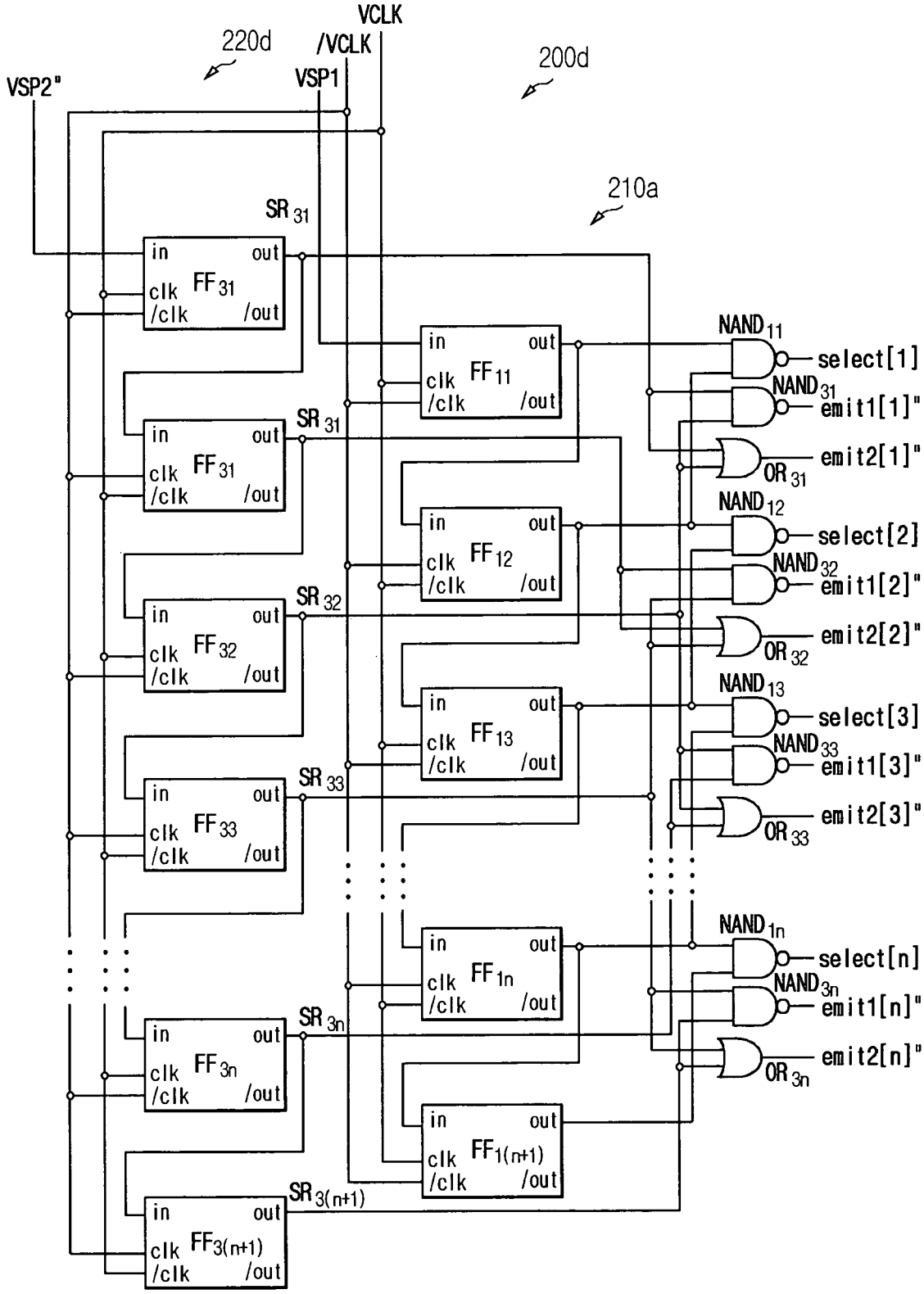
Figure 16:
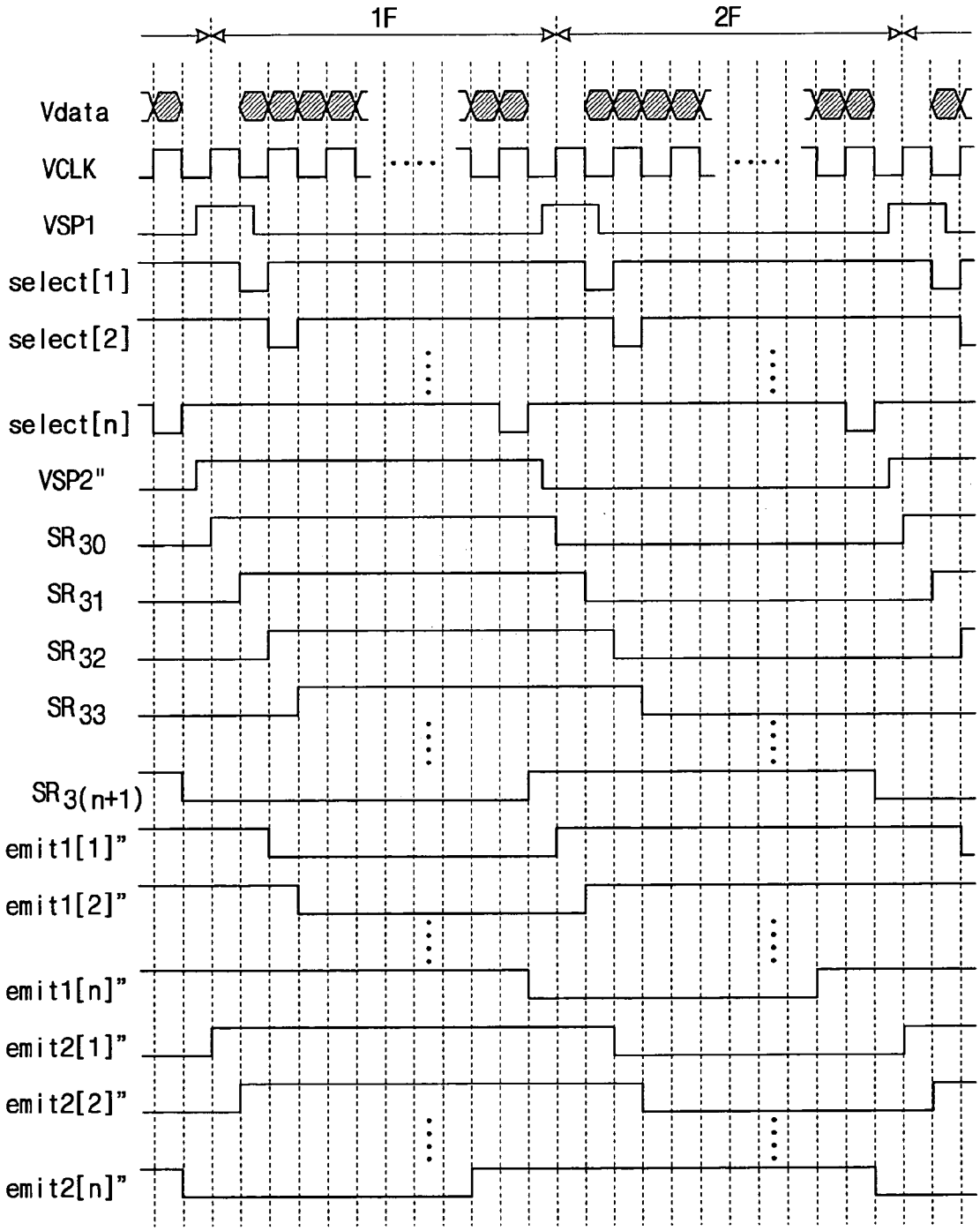

FIG. 15 shows a scan driver 200*d* in an organic light emitting diode display device according to an eight exemplary embodiment, and FIG. 16 shows a signal timing diagram of the scan driver 200*d* shown in FIG. 15.

As shown in FIG. 15, the scan driver 200*d* includes the shift register 210*a* for outputting the select signal select[i] and a shift register 220*d* for outputting the emission control signals emit1[*i*]" and emit2[*i*]". The shift register 220*d* further includes a flip-flop $FF_{30}$ before the flip-flop $FF_{31}$, which is different from the shift register 220*b* of FIG. 11, and a start signal VSP2" is inputted to the flip-flop $FF_{30}$. The flip-flop $FF_{30}$ receives the clock VCLK as the inner clock (clk).

In the shift register 220*d*, the $i^{th}$ NAND gate $NAND_{3i}$ performs a NAND operation between the output signals $SR_{3(i-1)}$ and $SR_{3(i+1)}$ of the $(i-1)^{th}$ and $(i+1)^{th}$ flip-flops $FF_{3(i-1)}$ and $FF_{3(i+1)}$ to output the emission control signal emit1[*i*]". The $i^{th}$ OR gate $OR_{3i}$ performs an OR operation between the output signals $SR_{3(i-1)}$ and $SR_{3(i+1)}$ of the $(i-1)^{th}$ and $(i+1)^{th}$ flip-flops $FF_{3(i-1)}$ and $FF_{3(i+1)}$ to output the emission control signal emit2[*i*]".

Referring to FIG. 16, the start signal VSP2" is high-level when the clock VCLK is high-level in the first subfield 1F, and is low-level when the clock VCLK is high-level in the second subfield 2F. Then, the output signal $SR_{3i}$ of the flip-flop $FF_{3i}$ is same as that $SR_{3i}$ shown in FIG. 12. Therefore, the emission control signals emit1[*i*]" and emit2[*i*]" are high-level when the previous and current select signal select[i−1] and select[i] have the low-level signals.

As described above, the select signals and the emission control signals are generated from the two shift registers each including the plurality of flip-flops. Next, exemplary embodiment which may reduce the number of the flip-flops compared to these exemplary embodiments, will be described.

Figure 17:
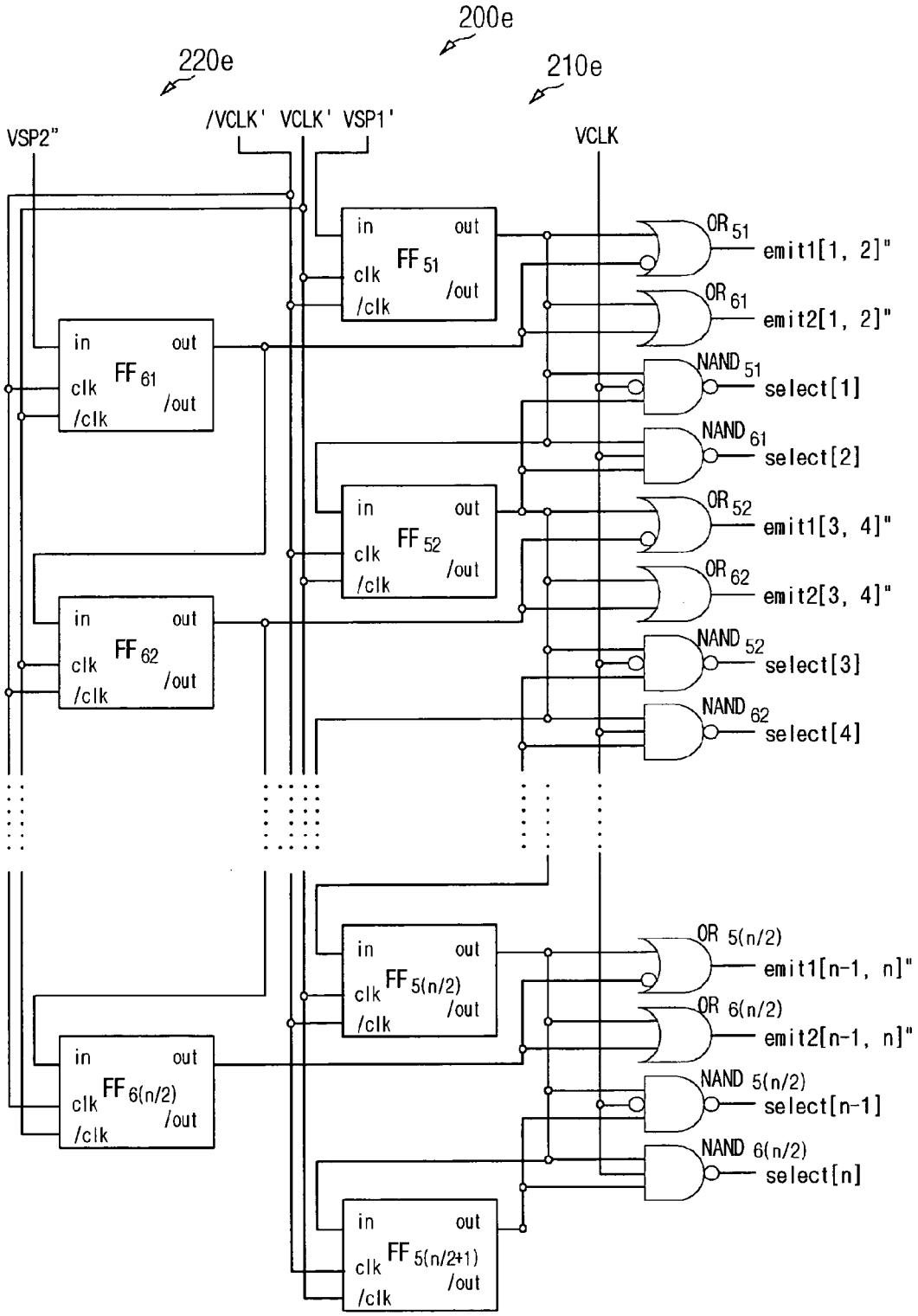
Figure 18:
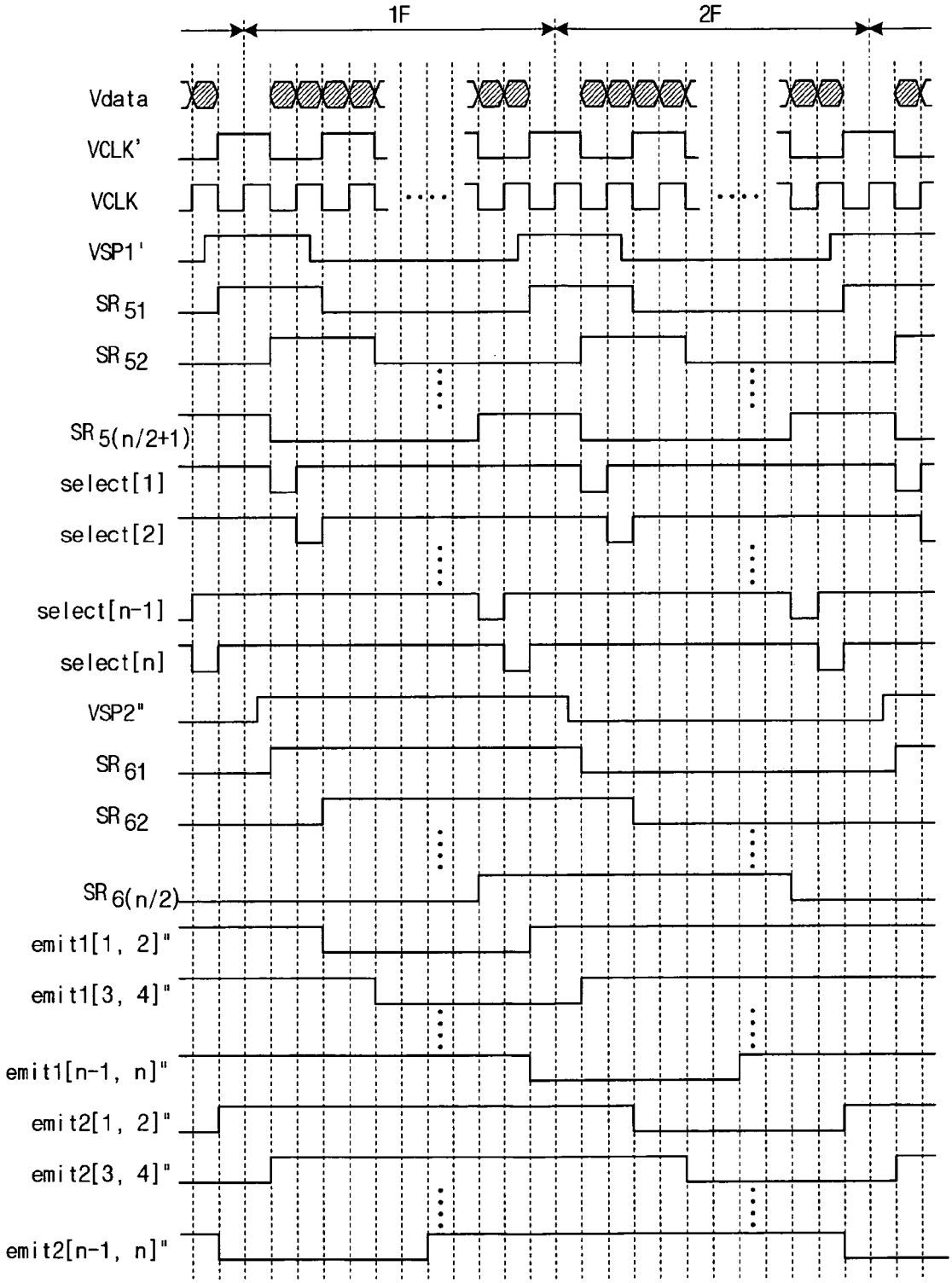

FIG. 17 shows a scan driver 200*e* in an organic light emitting diode display device according to a ninth exemplary embodiment, and FIG. 18 shows a signal timing diagram of the scan driver 200*e* shown in FIG. 17. A clock VCLK' used in the scan driver 200*e* of FIGS. 17 and 18 has twice the period of the clock VCLK of FIGS. 8 to 16, and the inverted clock /VCLK' is not shown in FIG. 18.

As shown in FIG. 17, the scan driver 200*e* includes a shift register 210*e* for outputting the select signal select[i] and a shift register 220*e* for outputting the emission control signals emit1[*i*]" and emit2[*i*]". The shift register 210*e* includes ((n/2)+1) flip-flops $FF_{51}$ to $FF_{5(n/2+1)}$, n NAND gates $NAND_{51}$ to $NAND_{5(n/2)}$, and $NAND_{61}$ to $NAND_{6(n/2)}$, and the shift register 220*e* includes (n/2) flip-flops $FF_{61}$ to $FF_{6(n/2)}$, and n OR gates $OR_{51}$ to $OR_{5(n/2)}$, and $OR_{61}$ to $OR_{6(n/2)}$ (where 'n' is assumed to an even number).

The clocks VCLK' and /VCLK' of the flip-flop $FF_{5(j+1)}$ are inverted to the clocks /VCLK' and VCLK' of the adjacent flip-flops $FF_{5j}$ in the shift register 210*e* (where 'j' is a positive integer less than or equal to 'n/2'), and the clock VCLK' is inputted to the flip-flop $FF_{51}$ as the inner clock (clk). As shown in FIG. 18, since the start signal VSP1' has the high-level signal in the high-level period of the one clock VCLK cycle in each of the subfields 1F and 2F, the flip-flops $FF_{51}$ to $FF_{5(n/2+1)}$ may sequentially output each output signal $SR_{5i}$ by shifting the high-level signal by the half clock VCLK' cycle. Here, the output signal $SR_{5i}$ has the high-level signal during one clock VCLK' cycle in each of the subfields 1F and 2F.

The $j^{th}$ NAND gate $NAND_{5j}$ performs a NAND operation of the output signals $SR_{5j}$ and $SR_{5(j+1)}$ of the flip-flops $FF_{5j}$ and $FF_{5(j+1)}$, and the inverted clock /VCLK to output the $(2j-1)^{th}$ select signal select[2j−1]. Therefore, the select signal select[2j−1] has the low-level signal during a low-level period of the clock VCLK of a period in which the both output signals $SR_{5j}$ and $SR_{5(j+1)}$ are high-level. The $j^{th}$ NAND gate $NAND_{6j}$ performs the NAND operation of the output signals $SR_{5j}$ and $SR_{5(j+1)}$ of the flip-flops $FF_{5j}$ and $FF_{5(j+1)}$, and the clock VCLK to output the $(2j)^{th}$ select signal select[2*j*]. Therefore, the select signal select[2*j*] has the low-level signal during a high-level period of the clock VCLK of the period in which the both output signals $SR_{5j}$ and $SR_{5(j+1)}$ are high-level.

The clocks VCLK' and /VCLK' of the flip-flop $FF_{6(j+1)}$ are inverted to the clocks /VCLK' and VCLK' of the adjacent flip-flops $FF_{6j}$ in the shift register 212*e*, and the inverted clock /VCLK' is inputted to the flip-flop $FF_{61}$ as the inner clock (clk). As shown in FIG. 18, since the start signal VSP2" has the high-level signal in the first subfield 1F, the flip-flops $FF_{61}$ to $FF_{6(n/2)}$ may sequentially output each output signal $SR_{6i}$ by shifting the high-level signal by the half clock VCLK' cycle.

Here, the output signal $SR_{6i}$ has the high-level signal during a period corresponding to the first subfield 1F.

The $j^{th}$ OR gate $OR_{5j}$ performs an OR operation of the output signal $SR_{5j}$ of the flip-flop $FF_{5j}$ and the inverted output signal $/SR_{6j}$ of the flip-flop $FF_{6j}$ to output the $(2j-1)^{th}$ and $(2j)^{th}$ emission control signals emit1[2*j*−1]" and emit1[2*j*]" (shown as emit1[2*j*−1, 2*j*] in FIG. 17) in the first subfield 1F. Therefore, the emission control signals emit1[2*j*−1]" and emit1[2*j*]" have the low-level signal during a period in which the both output signal $SR_{5j}$ of the flip-flop $FF_{5j}$ and inverted output signal $/SR_{6j}$ of the flip-flop $FF_{6j}$ are low-level. The $j^{th}$ OR gate $OR_{6j}$ performs the OR operation of the output signal $SR_{5j}$ of the flip-flop $FF_{5j}$ and the output signal $SR_{6j}$ of the flip-flop $FF_{6j}$ to output the $(2j-1)^{th}$ and $(2j)^{th}$ emission control signals emit2[2*j*−1]" and emit2[2*j*]" (shown as emit2[2*j*−1, 2*j*] in FIG. 17) in the second subfield 2F. Therefore, the emission control signals emit2[2*j*−1]" and emit2[2*j*]" have the low-level signal during a period in which the both output signals $SR_{5j}$ and $SR_{6j}$ of the flip-flops $FF_{5j}$ and $FF_{6j}$ are low-level.

As a result, as shown in FIG. 18, the emission control signals emit1[2*j*−1]" and emit2[2*j*−1]" are high-level when the previous and current select signals select[2*j*−2] and select [2*j*−1] have the low-level signals, and the emission control signals emit1[2*j*]" and emit2[2*j*]" are high-level when the previous and current select signals select[2*j*−1] and select[2*j*] have the low-level signal.

Next, exemplary embodiments which use one shift register to output the select signals and the emission control signals will be described with reference to FIGS. 19 to 26.

First, a scan driver 200*f* for outputting the emission control signals emit1[*i*] and emit2[*i*] shown in FIG. 9 will be described with reference to FIGS. 19 and 20.

Figure 19:
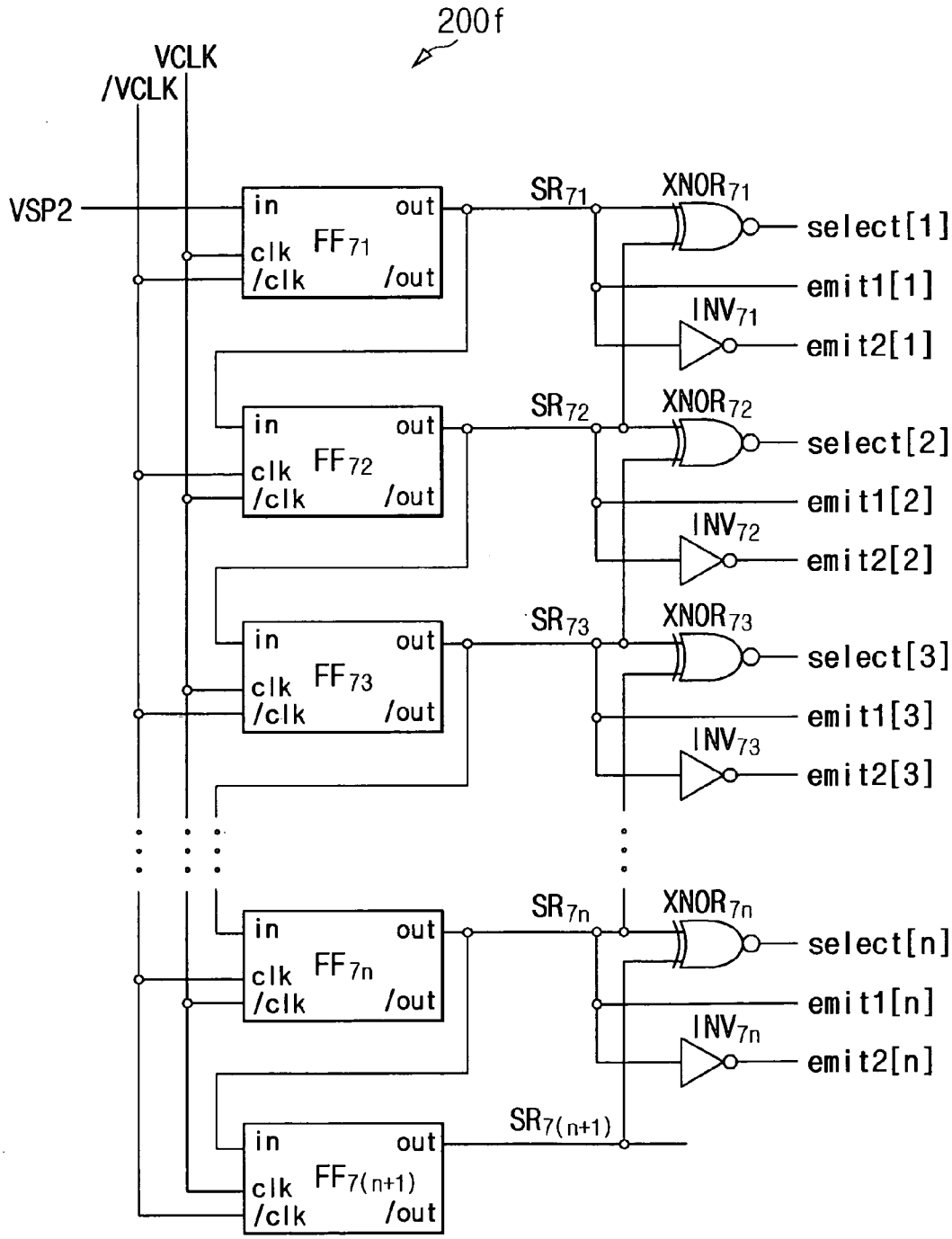
Figure 20:
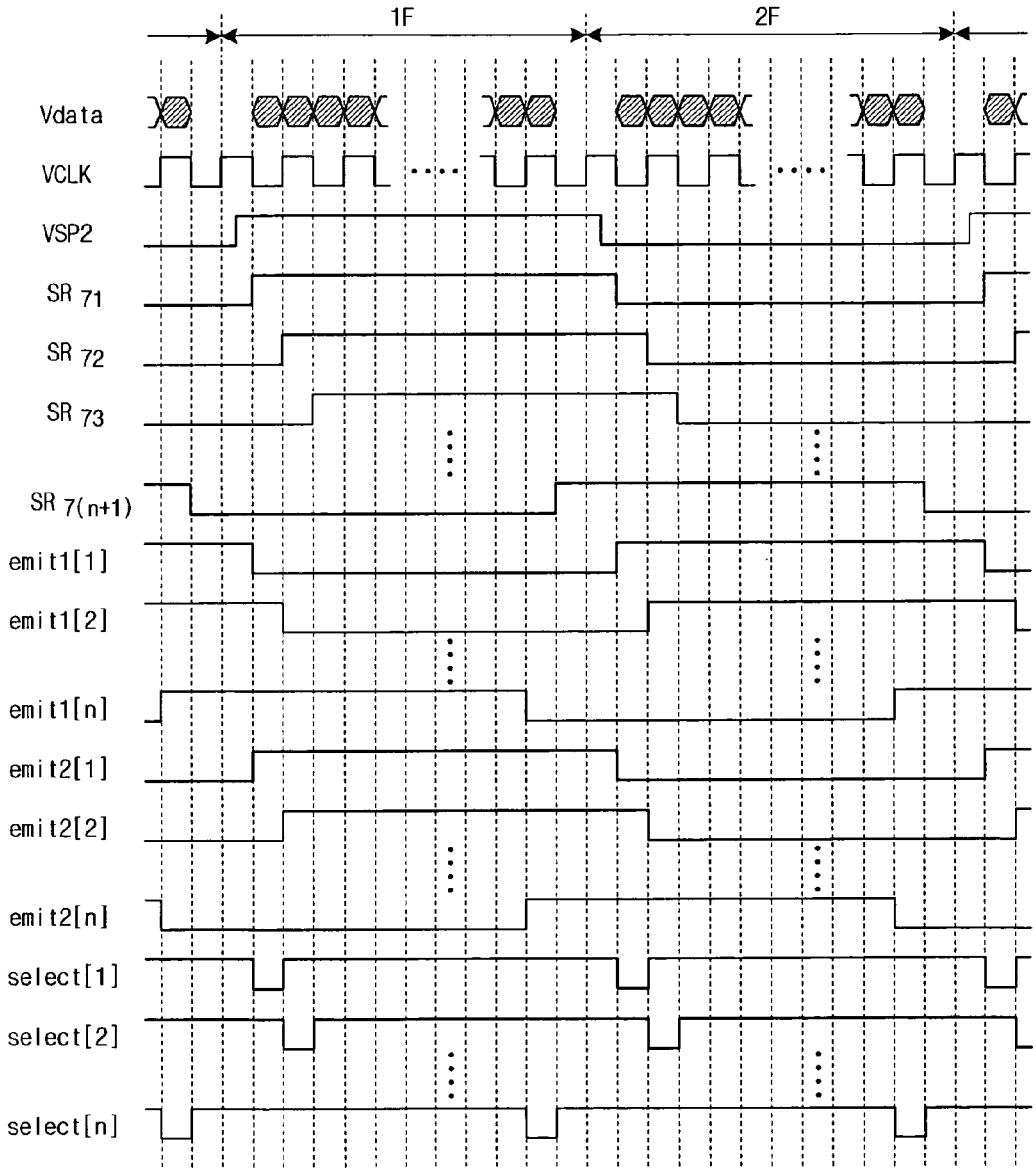

FIG. 19 shows the scan driver 200*f* in an organic light emitting diode display device according to a tenth exemplary embodiment, and FIG. 20 shows a signal timing diagram of the scan driver 200*f* shown in FIG. 19.

As shown in FIG. 19, the scan driver 200*f* includes (n+1) flip-flops $FF_{71}$ to $FF_{7(n+1)}$, n XNOR gates $XNOR_{71}$ to $XNOR_{7n}$, and n inverters $INV_{71}$ to $INV_{7n}$, and operates as a shift register. The flip-flops $FF_{71}$ to $FF_{7(n+1)}$ and the n inverters $INV_{71}$ to $INV_{7n}$ have the same structure as the flip-flops $FF_{11}$ to $FF_{1(n+1)}$ and the n inverters $INV_{21}$ to $INV_{2n}$ shown in FIG. 8. In addition, the flip-flops $FF_{71}$ to $FF_{7(n+1)}$ use the clock VCLK and the start signal VSP2 shown in FIG. 9.

Therefore, an output signal $SR_{7i}$ of the flip-flop $FF_{7i}$ is same as the emission control signal emit1[*i*] of the first subfield 1F, and the output signal of the inverter $INV_{7i}$ is same as the emission control signal emit2[*i*] of the second subfield 2F. In addition, the inverted output signal (/out) of the flip-flop $FF_{7i}$ may be used as the emission control signal emit2[*i*] instead of the output signal of the inverter $INV_{7i}$.

The XNOR gate $XNOR_{7i}$ performs XNOR operation between the output signals $SR_{7i}$ and $SR_{7(i+1)}$ of the flip-flops $FF_{7i}$ and $FF_{7(i+1)}$ to output the select signal select[i]. That is, the XNOR gate $XNOR_{7i}$ outputs the low-level select signal select[i] while the output signals $SR_{7i}$ and $SR_{7(i+1)}$ of the flip-flops $FF_{7i}$ and $FF_{7(i+1)}$ have the different levels. Accordingly, the select signal select[i] has the low-level signals during a period corresponding to the half clock VCLK cycle from the falling edge of the output signal $SR_{7i}$ and a period corresponding to the half clock VCLK cycle from the rising edge of the output signal $SR_{7i}$. As a result, the emission control signals emit1[*i*] and emit2[*i*] become low-level together with the select signal select[i] in the first and second subfields 1F and 2F, respectively.

Next, scan drivers 200*g* and 220*h* for outputting the emission control signals emit1[*i*]' and emit2[*i*]' shown in FIG. 12 will be described with reference to FIGS. 21 to 23.

Figure 21:
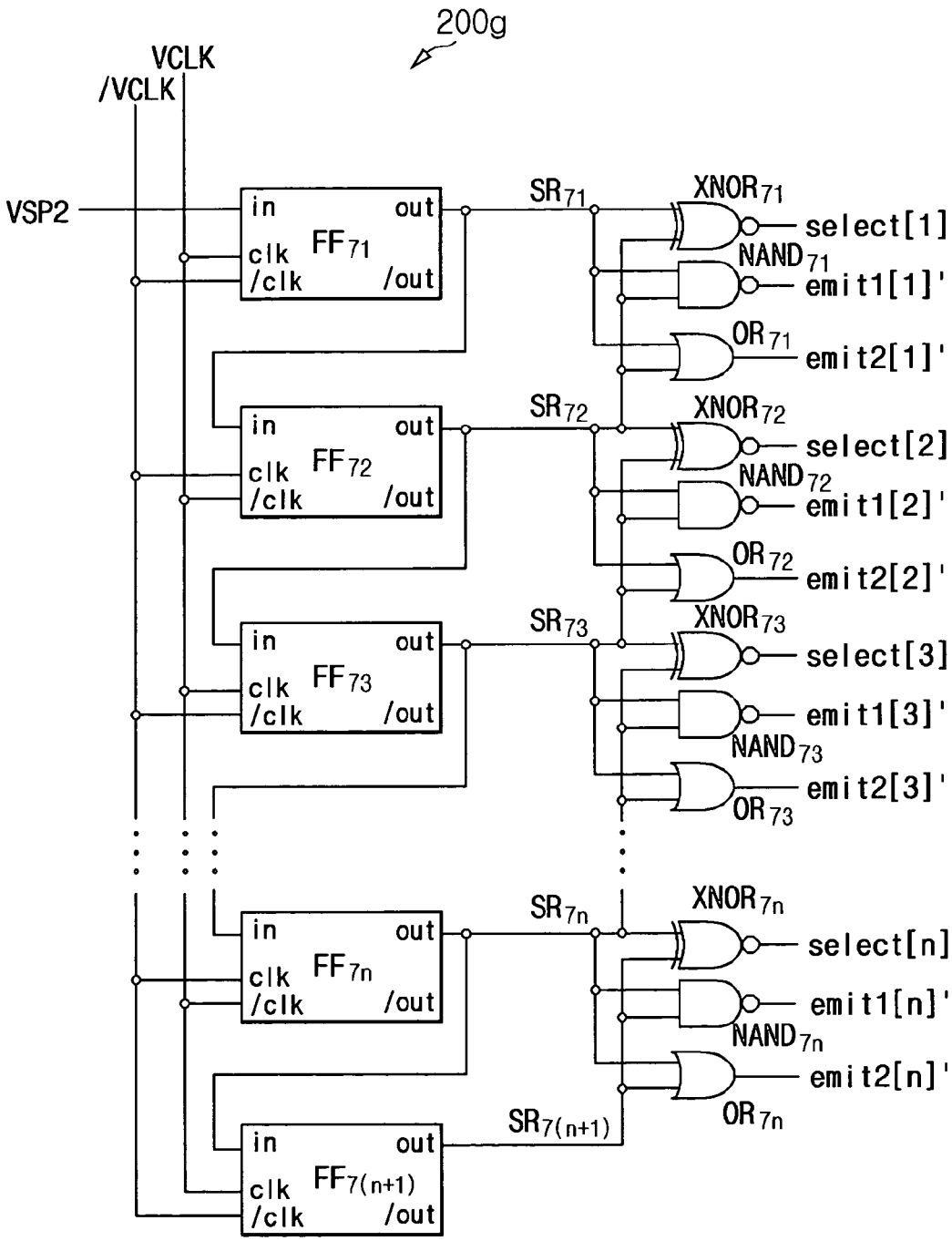
Figure 22:
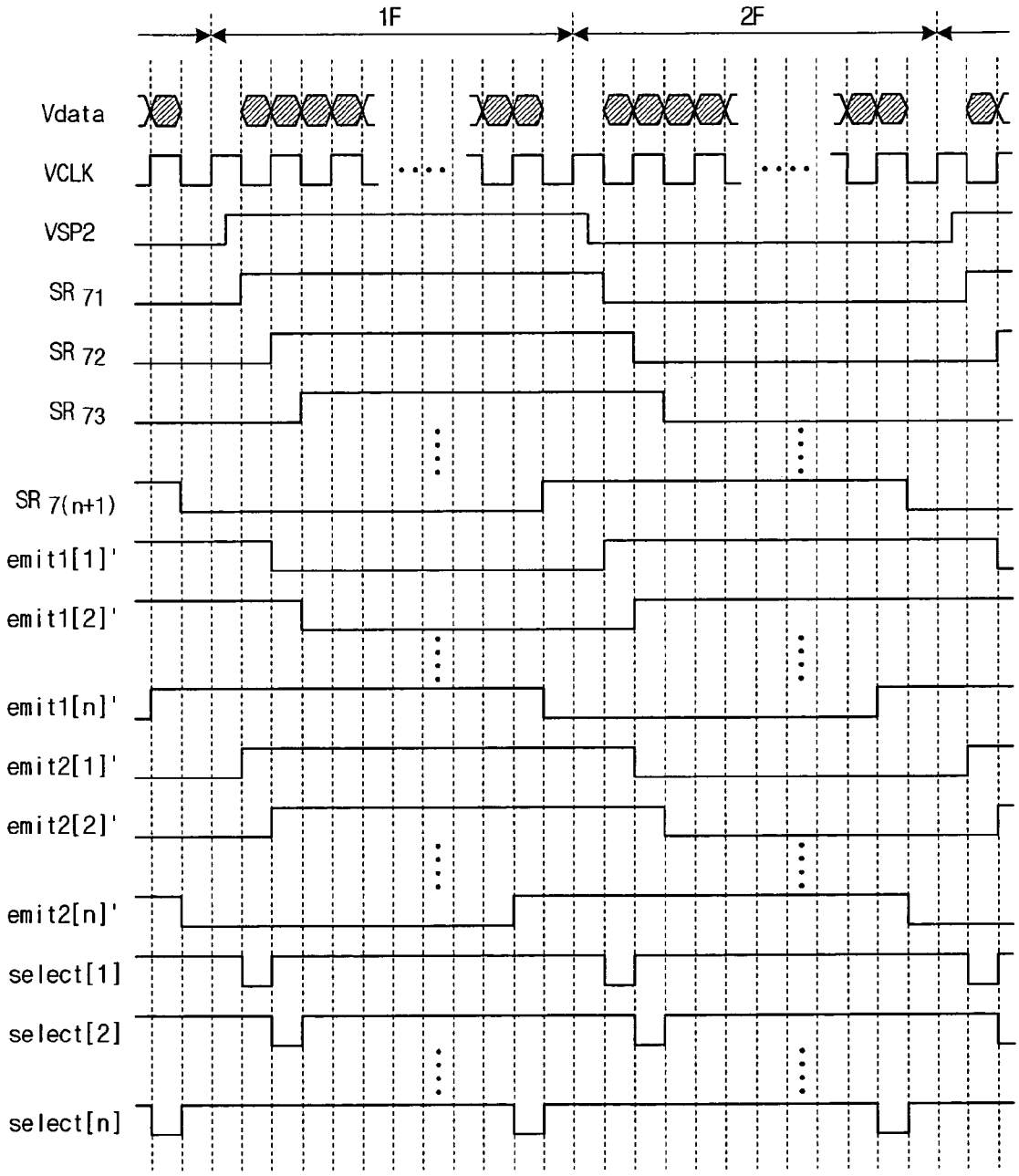

FIG. 21 shows the scan driver 200*g* in an organic light emitting diode display device according to an eleventh exemplary embodiment, and FIG. 22 shows a signal timing diagram of the scan driver 200*g* shown in FIG. 21.

As shown in FIG. 21, the scan driver 200*g* has the same structure as the scan driver 200*f* of FIG. 19 except that the emission control signals emit1[*i*]' and emit2[*i*]' are generated from a NAND gate $NAND_{7i}$ and an OR gate $OR_{7i}$.

In more detail, the $i^{th}$ NAND gate $NAND_{7i}$ performs a NAND operation between the output signals $SR_{7i}$ and $SR_{7(i+1)}$ of the flip-flops $FF_{7i}$ and $FF_{7(i+1)}$ to output the emission control signal emit1[*i*]' of the first subfield 1F, and the $i^{th}$ OR gate $OR_{7i}$ performs an OR operation between the output signals $SR_{7i}$ and $SR_{7(i+1)}$ of the flip-flops $FF_{7i}$ and $FF_{7(i+1)}$ to output the emission control signal emit2[*i*]' of the second subfield 2F. Then, since the emission control signals emit1[*i*]' and emit2[*i*]' are at high-level in a period corresponding to the low-level signal of the select signal select[i], the emission control signals emit1[*i*]' and emit2[*i*]' shown in FIG. 22 can be outputted.

Figure 23:
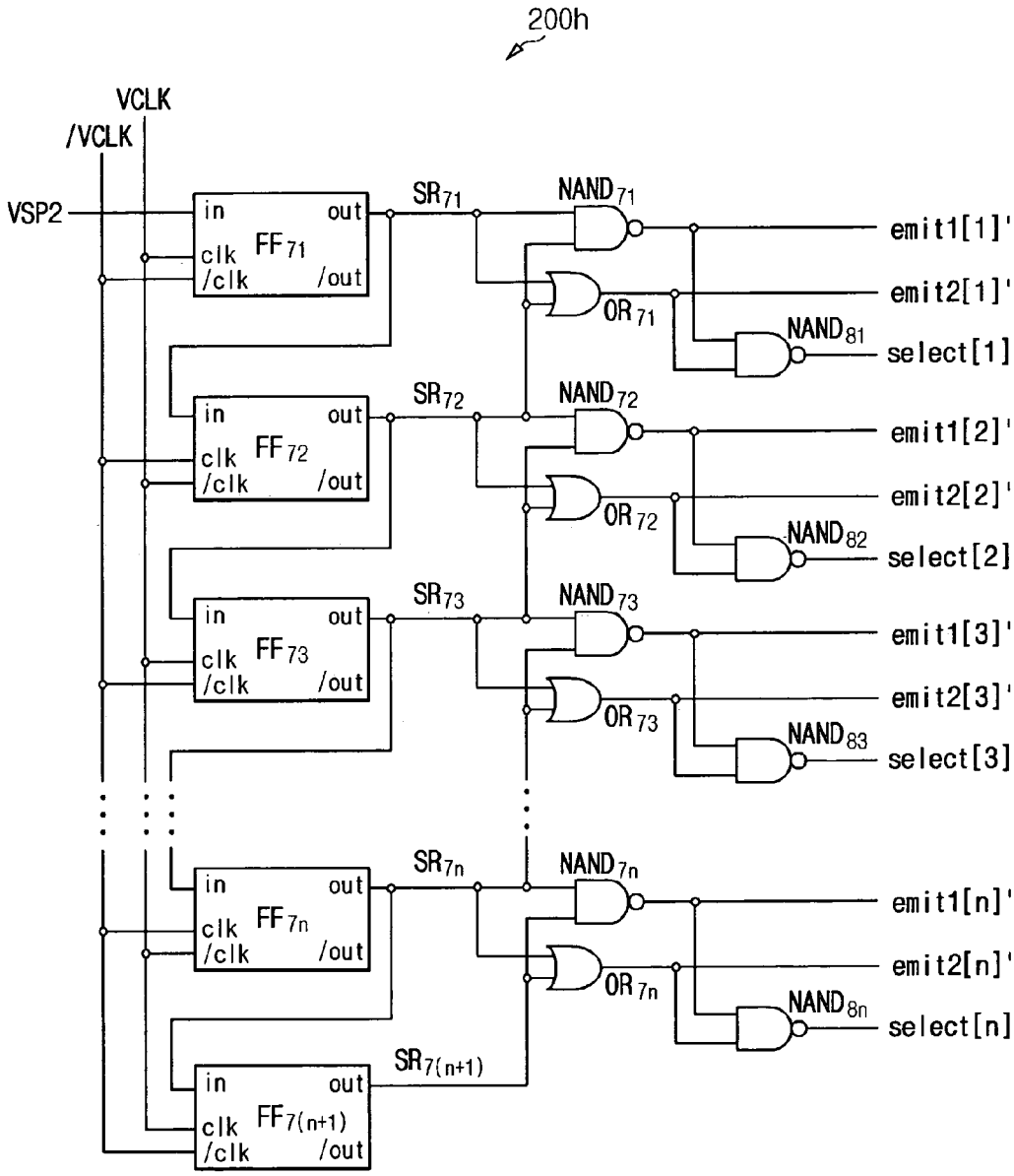

FIG. 23 shows the scan driver 200*h* in an organic light emitting diode display device according to a twelfth exemplary embodiment.

As shown in FIG. 23, the scan driver 200*h* has the same structure as the scan driver 200*g* of FIG. 21 except that the select signal select[i] are generated from a NAND gate $NAND_{8i}$.

Referring to FIG. 22, the two emission control signal emit1 [*i*]' and emit2[*i*]' have high-levels during a period in which the select signal select[i] has low-level. Therefore, the select signal select[i] can be generated by the NAND operation of the emission control signals emit1[*i*]' and emit2[*i*]' which is performed by the NAND gate NAN $D_{8i}$.

Next, a scan driver 200*i* for outputting the emission control signals emit1[*i*]" and emit2[*i*]" shown in FIG. 14 will be described with reference to FIGS. 24 to 26.

Figure 24:
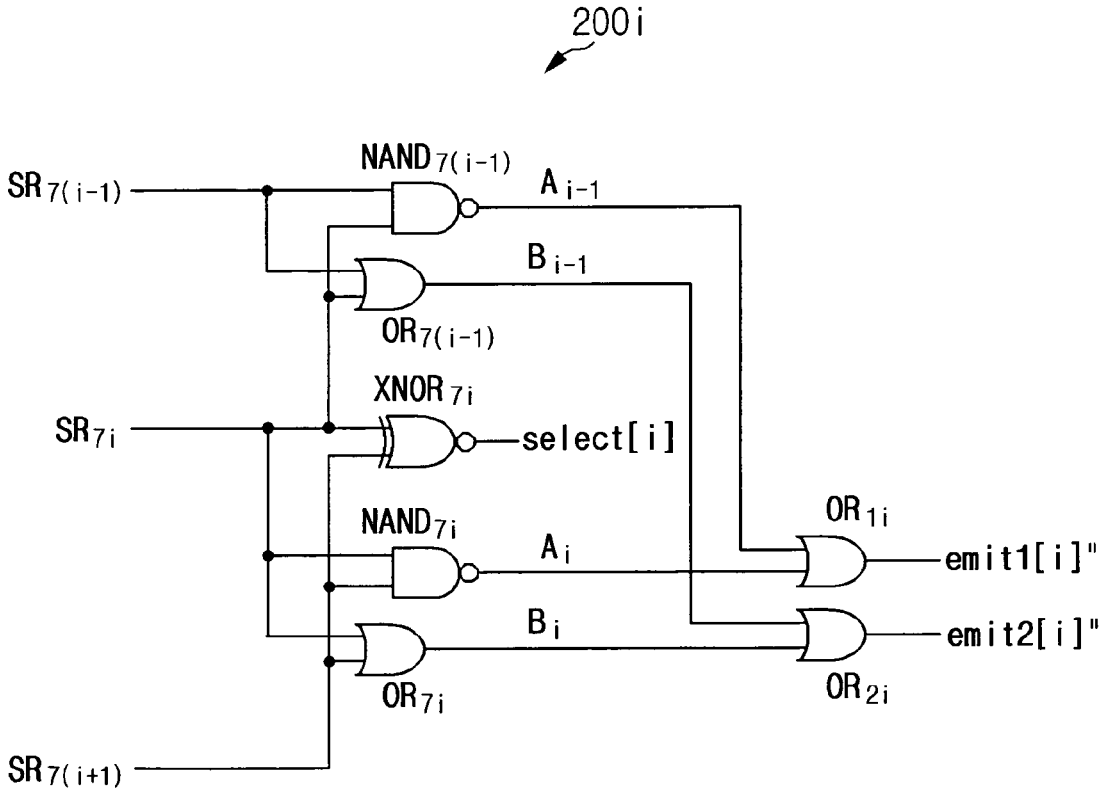
Figure 25:
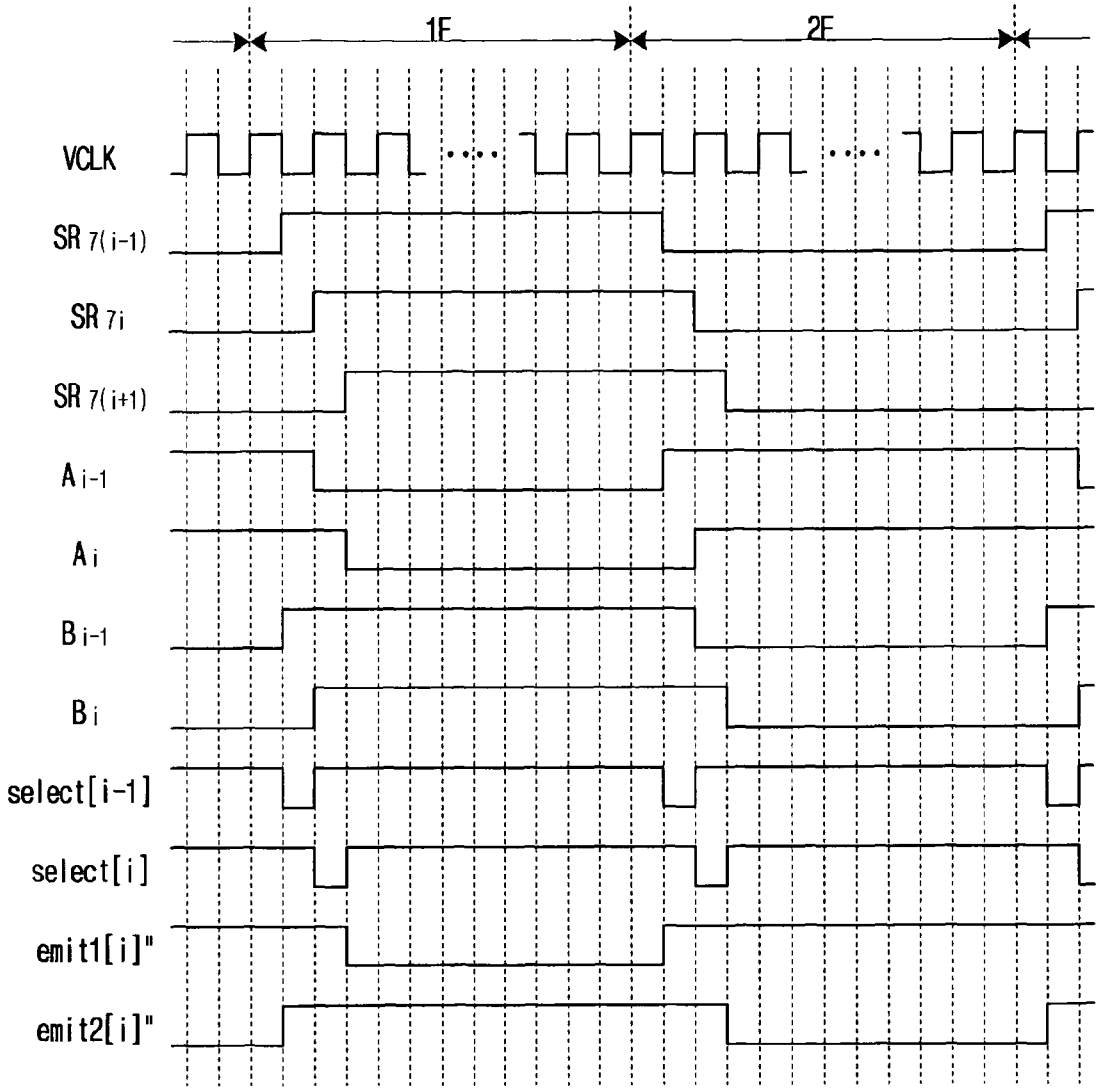

FIG. 24 shows the scan driver 200*i* in an organic light emitting diode display device according to a thirteenth exemplary embodiment, and FIG. 25 shows a signal timing diagram of the scan driver 200*i* shown in FIG. 24.

The scan driver 200*i* of FIG. 24 further includes 2n OR gates $OR_{11}$ to $OR_{1n}$ and $OR_{21}$ to $OR_{2n}$ in addition to the elements of the scan driver 200*g* of FIG. 21, and the flip-flops $FF_{71}$ to $FF_{7n}$ are not shown in FIG. 24. In addition, the $i^{th}$ OR gates $OR_{1i}$ and $OR_{2i}$, $(i-1)^{th}$ and $i^{th}$ NAND gates $NAND_{7(i-1)}$ and $NAND_{7i}$, $(i-1)^{th}$ and $i^{th}$ OR gates $OR_{7(i-1)}$ and $OR_{7i}$, and $i^{th}$ XNOR gate $XNOR_{7i}$ are shown in FIG. 24. In FIGS. 24 and 25, the signals $SR_{7(i-1)}$, $SR_{7i}$, and $SR_{7(i+1)}$ respectively correspond to the output signals of the flip-flops $FF_{7(i-1)}$, $FF_{7i}$, and $FF_{7(i+1)}$, and signals $A_i$ and $B_i$ respectively correspond to the emission control signals emit1[*i*]' and emit2[*i*]' of the scan driver 200*g* shown in FIG. 21.

As shown in FIG. 25, the OR gate $OR_{1i}$ performs an OR operation of the signals $A_{i-1}$ and $A_i$ to output the emission control signals emit1[*i*]" during a period in which the both signals $A_{i-1}$ and $A_i$ are low-level. In addition, the OR gate $OR_{2i}$ performs an OR operation of the signals $B_{1-1}$ and $B_i$ to output the emission control signals emit2[*i*]" during a period in which the both signals $B_{i-1}$ and $B_i$ are low-level. These emission control signals emit1[*i*]" and emit2[*i*]" are same as those shown in FIG. 14.

In addition, if the output signals $A_{i-k}$ and $A_{i+p}$ of the $(i-k)^{th}$ and $(i+p)^{th}$ NAND gates $NAND_{i-k}$ and $NAND_{i+p}$ are inputted to the $i^{th}$ OR gates $OR_{1i}$ and $OR_{2i}$ (where 'k' and 'p' are respectively positive integers), the low-level periods of the emission control signals emit1[*i*]" and emit2[*i*]" may be controlled by an integral multiple of the half clock VCLK cycle.

Figure 26:
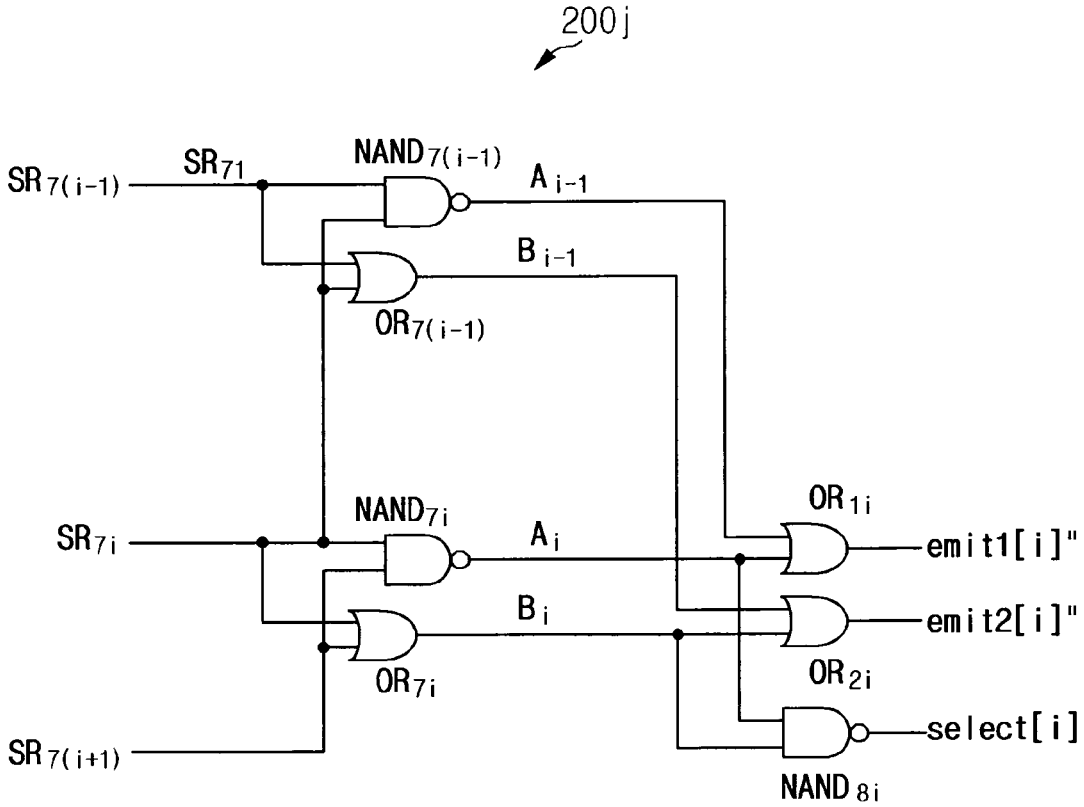

FIG. 26 shows a scan driver 200*j* in an organic light emitting diode display device according to a fourteenth exemplary embodiment.

As shown in FIG. 26, the scan driver 200*j* includes a NAND gate $NAND_{8i}$ instead of the XNOR gate $XNOR_{7i}$ in the scan driver 200*i* of FIG. 24. The $i^{th}$ NAND gate $NAND_{8i}$ performs a NAND operation of the output signal $A_i$ of the $i^{th}$ NAND gate $NAND_{7i}$ and the output signal $B_i$ of the $i^{th}$ OR gate $OR_{7i}$ to output the select signal select[i] as described in reference to FIG. 23.

In the above exemplary embodiments, the cases in which the width of the low-level signal of the select signal select[i] is same as the half clock VCLK cycle have been described. That is, the rising edge of the select signal select[i−1] corresponds to the falling edge of the select signal select[i]. In other embodiment, however, the falling edge of the select signal select[i] may be apart from the rising edge of the select signal select[i−1]. That is, the width of the low-level signal of the select signal select[i] may be shorter than the half clock VCLK cycle. One such exemplary embodiment will be described with reference to FIGS. 27 and 28.

Figure 27:
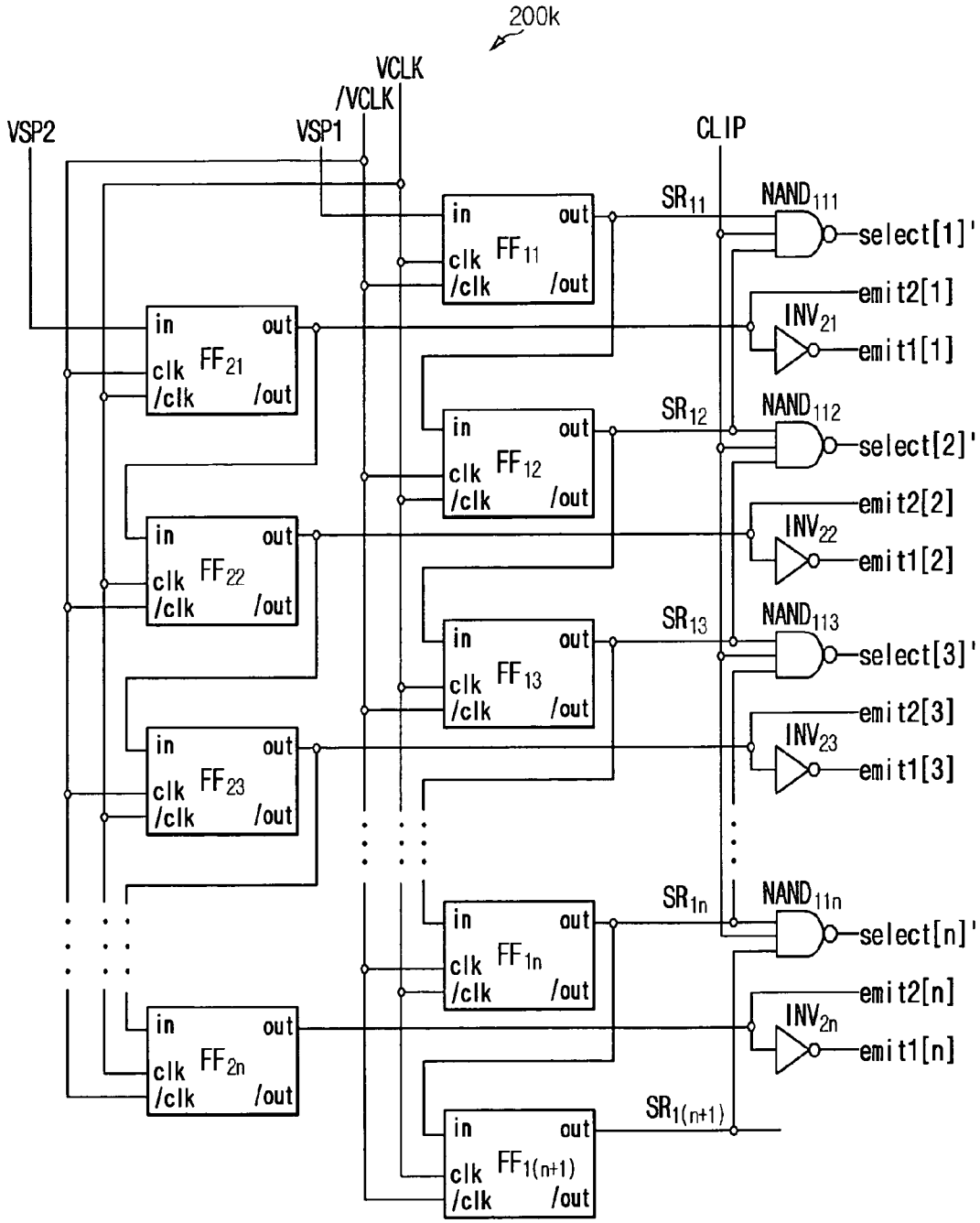
Figure 28:
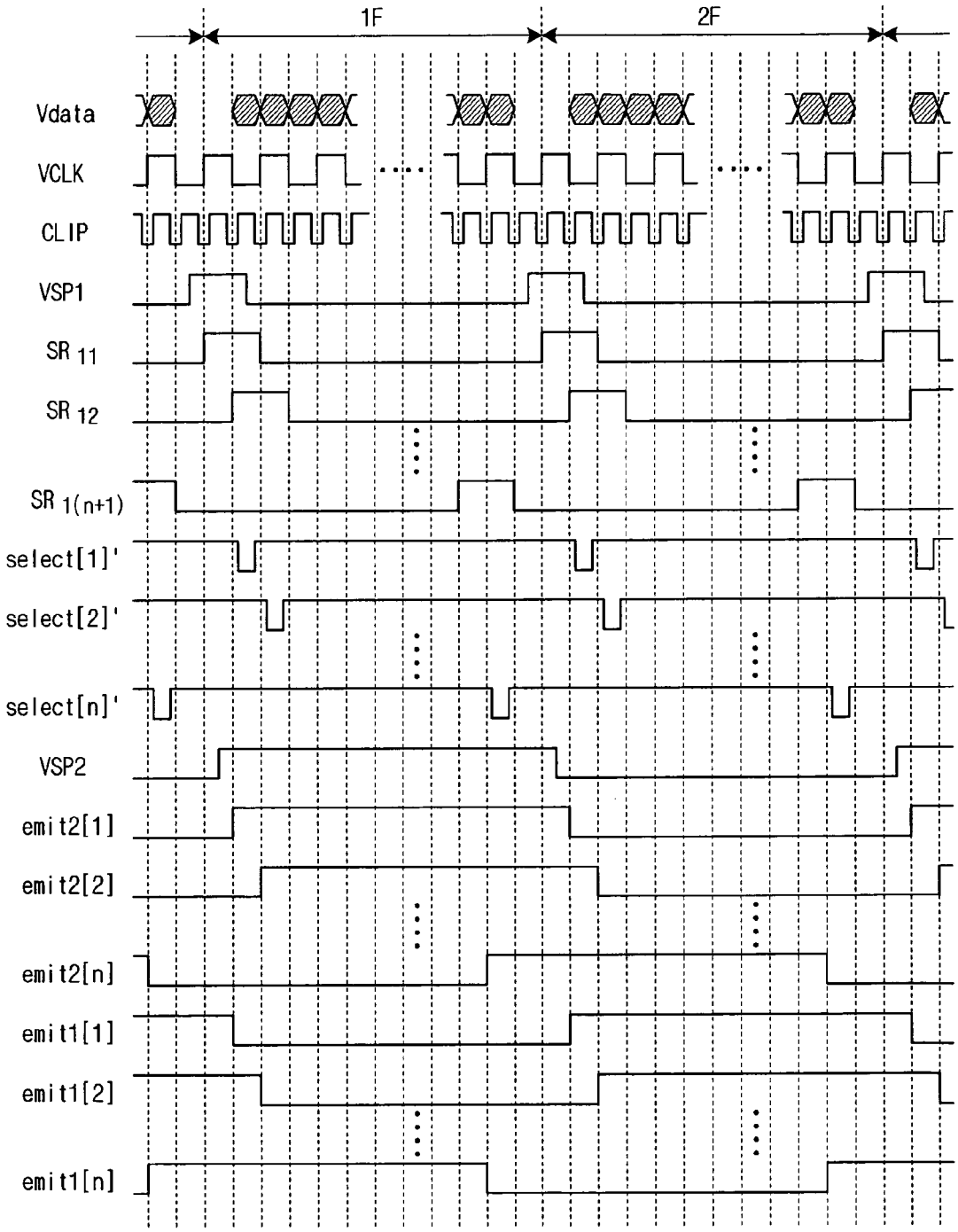

FIG. 27 shows a scan driver 200*k* in an organic light emitting diode display device according to a fifteenth exemplary embodiment, and FIG. 28 shows a signal timing diagram of the scan driver 200*k* shown in FIG. 27. In FIGS. 27 and 28, the case in which the low-level signal width (e.g., low-level pulse width) of the select signal is reduced in the scan driver 200*a* of FIGS. 8 and 9 will be described.

As shown in FIGS. 27 and 28, the scan driver 200*k* has the same structure as the scan driver 200*a* of FIGS. 8 and 9 except for a clip signal CLIP, and NAND gates $NAND_{11i}$ (i.e., $NAND_{111}$ to $NAND_{11n}$), to which the clip signal CLIP is applied in addition to the output signals $SR_{1i}$ and $SR_{1(i+1)}$. The clip signal CLIP has a cycle corresponding to the half clock VCLK cycle, and has the low-level signal whose width is shorter than the half clock VCLK cycle. In addition, the low-level period of the clip signal CLIP includes the falling edge or the rising edge of the clock VCLK.

Then, the NAND gate $NAND_{11i}$ outputs the low-level signal of the select signal select[i]' (i.e., one of select signals select[1]' to select[n]') during a period in which the clip signal CLIP is high-level. That is, the falling edge of the select signal select[i]' is apart from the rising edge of the select signal select[i−1]' by the low-level signal width (e.g., low-level pulse width) of the clip signal CLIP.

The principles of the exemplary embodiment described in FIGS. 27 and 28 may also be applicable to the other exemplary embodiments described above.

In addition, the scan driver may be divided into a scan driver for driving the unit pixels formed on the odd row (hereinafter, "an odd row scan driver") and a scan driver for driving the unit pixels formed on the even row (hereinafter, "an even row scan driver"). This exemplary embodiment will be described with reference to FIGS. 29 to 31.

Figure 29:
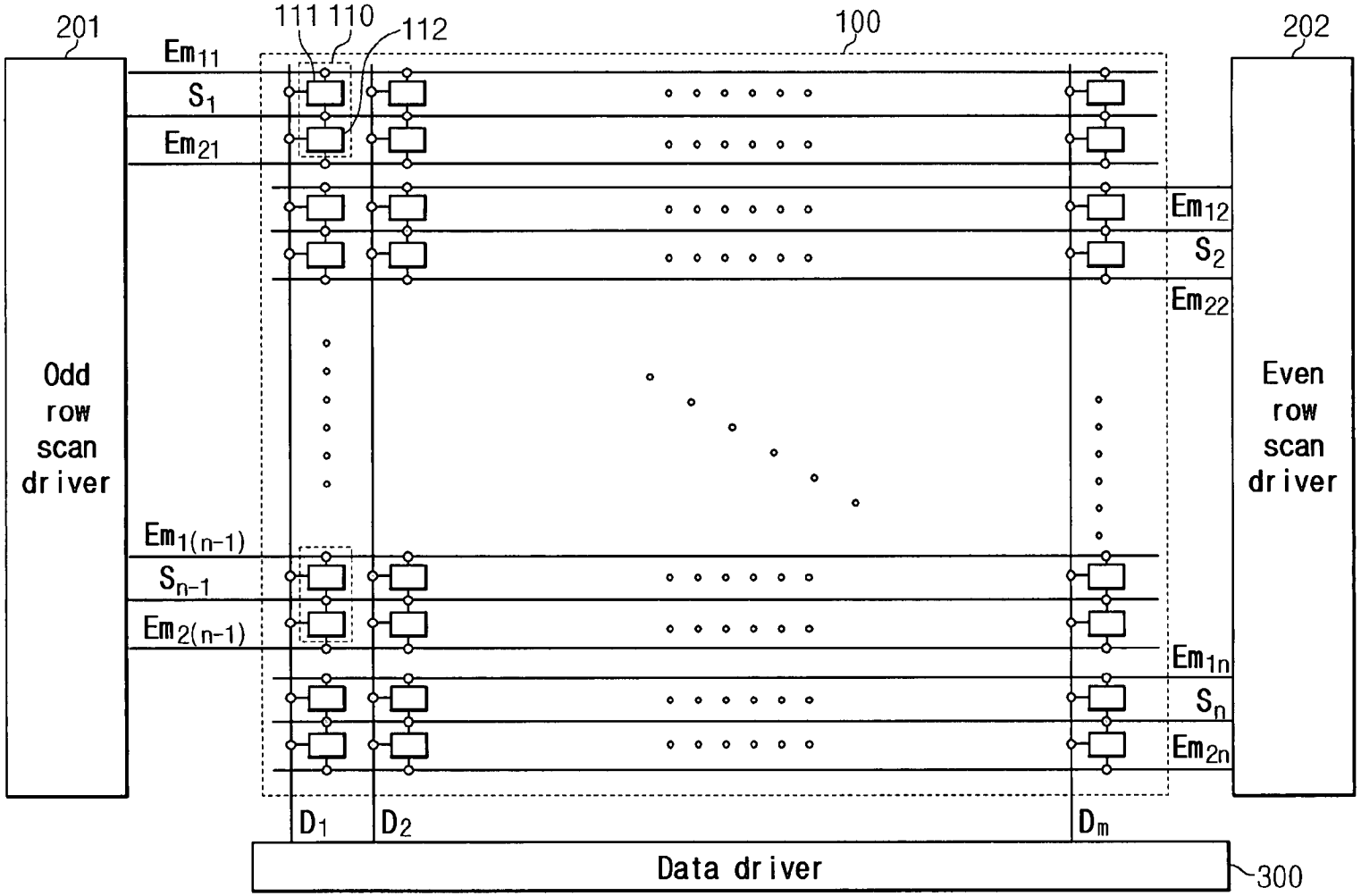
FIG. 29 shows a plan view of an organic light emitting diode display device according to a sixteenth exemplary embodiment of the present invention.
Figure 30A:
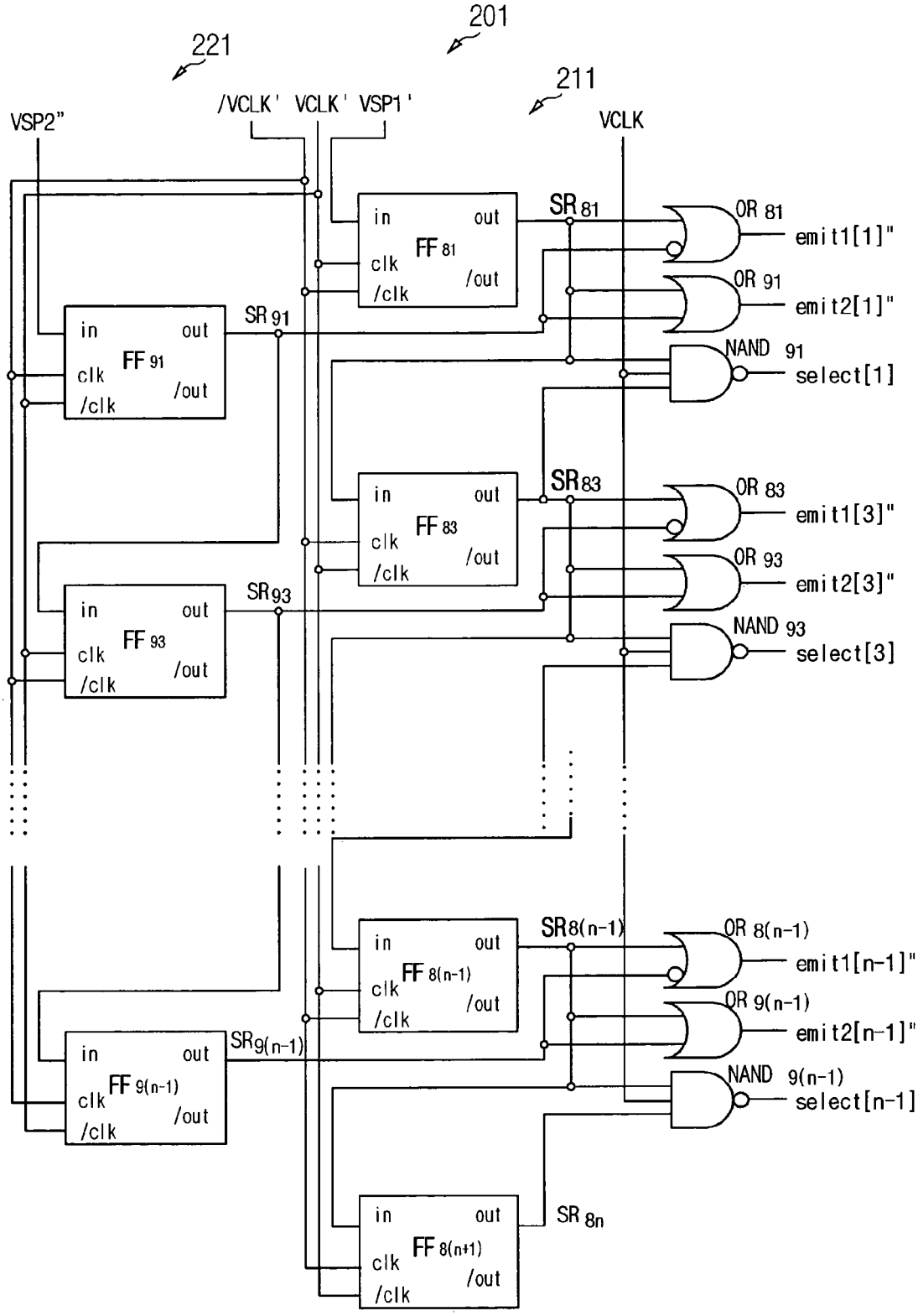
FIGS. 30A and 30B respectively show odd row and even row scan drivers in the organic light emitting diode display device according to the sixteenth exemplary embodiment.
Figure 30B:
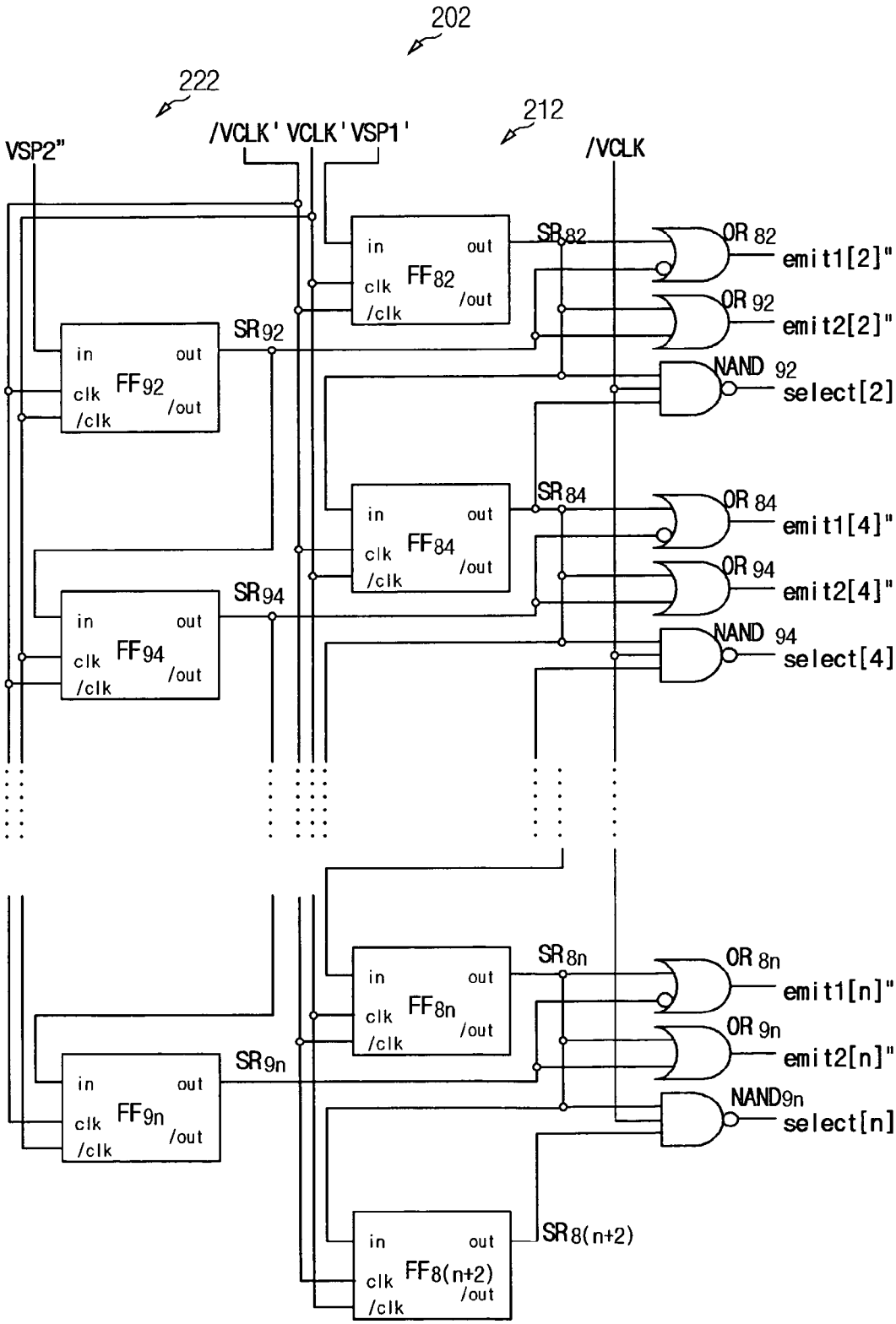
Figure 31:
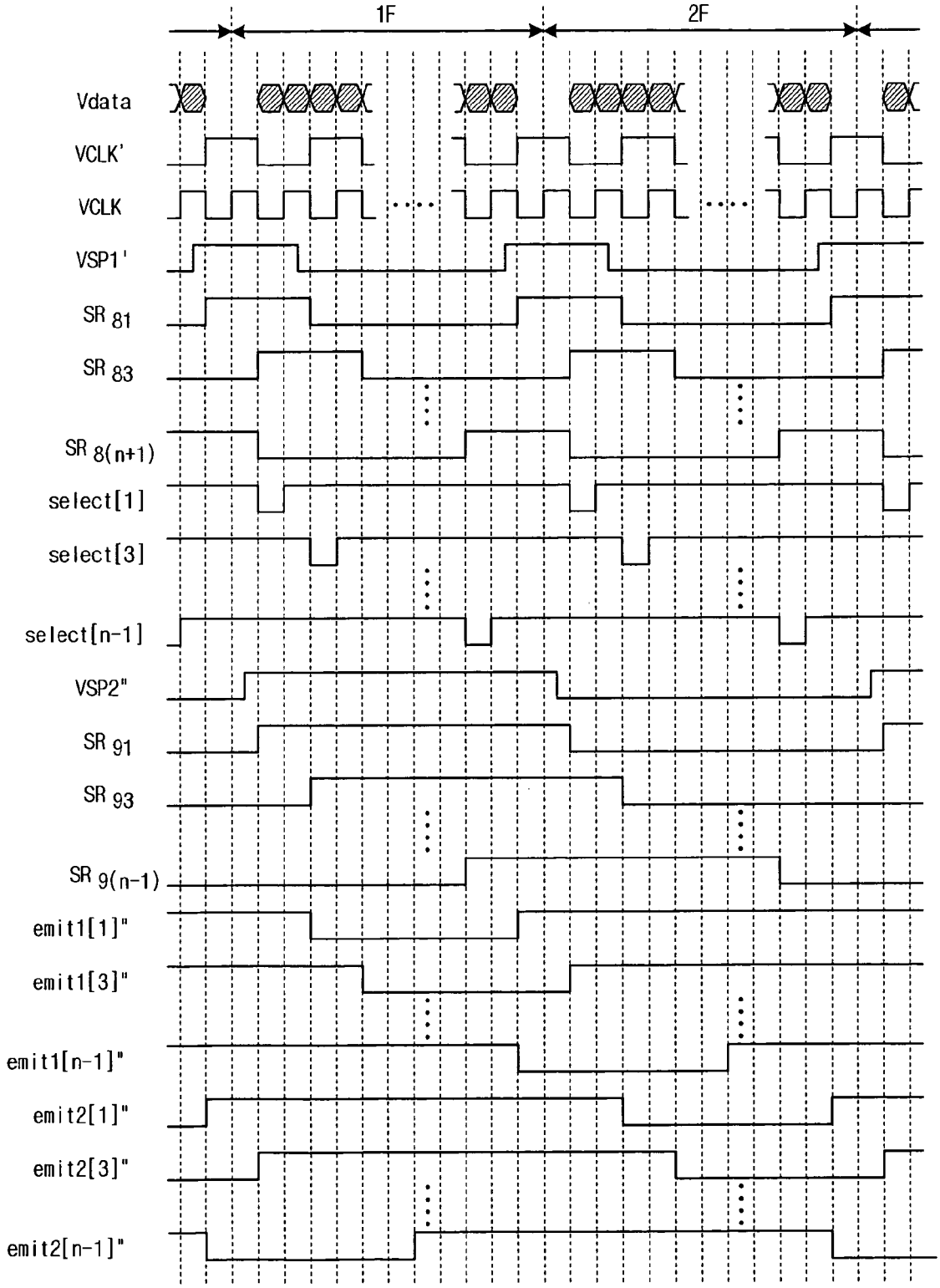
FIG. 31 shows a signal timing diagram of the odd row scan driver of FIG. 30A.

FIG. 29 shows a plan view of an organic light emitting diode display device according to a sixteenth exemplary embodiment of the present invention, FIGS. 30A and 30B respectively show odd row and even row scan drivers 201 and 202 in the organic light emitting diode display device according to the sixteenth exemplary embodiment, and FIG. 31 shows a signal timing diagram of the odd row scan driver 201 shown in FIG. 30A.

As shown in FIG. 29, the organic light emitting diode display device according to the sixteenth exemplary embodiment has the same structure as that of FIG. 1 except for the scan drivers 201 and 202.

The odd row scan driver 201 is formed on one side of the display area 100, and sequentially transmits the select signals select[2*j*−1] to the odd-numbered select scan lines $S_{2j-1}$ (where 'j' is a positive integer less than or equal to n/2). The even row scan driver 202 is formed on the other side of the display area 100, and sequentially transmits the select signals select[2*j*] to the even-numbered select scan lines $S_{2j}$. In addition, the odd row scan driver 201 sequentially transmits emission control signals emit1[2*j*−1]" to the odd-numbered emit scan lines $Em_{1(2j-1)}$ in the first subfield 1F, and sequentially transmits emission control signals emit2[2*j*−1]" to the odd-numbered emit scan lines $Em_{2(j-1)}$ in the second subfield 2F. The even row scan driver 202 sequentially transmits emission control signals emit1[2*j*]" to the even-numbered emit scan lines $Em_{1(2j)}$ in the first subfield 1F, and sequentially transmits emission control signals emit2[2*j*]" to the even-numbered emit scan lines $Em_{2(2j)}$ in the second subfield 2F.

Referring to FIG. 30A, the odd row scan driver 201 has a structure in which NAND gates $NAND_{61}$ to $NAND_{6(n/2)}$ for even-numbered select signals are eliminated from the scan driver 200*e* shown in FIG. 17. In more detail, the odd row scan driver 201 includes a shift register 211 for outputting the odd-numbered select signals select[2*j*−1] and a shift register 221 for outputting the odd-numbered emission control signals emit1[2*j*−1]" and emit2[2*j*−1]". The shift register 211 includes ((n/2)+1) flip-flops $FF_{81}$, $FF_{83}$, . . . , $FF_{8(n+1)}$, and (n/2) NAND gates $NAND_{91}$, $NAND_{93}$, . . . , $NAND_{9(n-1)}$, and the shift register 221 includes (n/2) flip-flops $FF_{91}$, $FF_{93}$, . . . , $FF_{9(n-1)}$, and n OR gates $OR_{81}$, $OR_{83}$, . . . , $OR_{8(n-1)}$, and $OR_{91}$, $OR_{93}$, . . . , $OR_{9(n-1)}$.

Referring to FIG. 30B, the even row scan driver 202 has a structure in which the NAND gates $NAND_{51}$ to $NAND_{5(n/2)}$ for odd-numbered select signals are eliminated from the scan driver 200*e* shown in FIG. 17. In more detail, the even row scan driver 202 includes a shift register 212 for outputting the even-numbered select signal select[2*j*] and a shift register 222 for outputting the even-numbered emission control signals emit1[2*j*]" and emit2[2*j*]". The shift register 212 includes ((n/2)+1) flip-flops $FF_{82}$ $FF_{84}$, . . . , $FF_{8(n+2)}$, and (n/2) NAND gates $NAND_{92}$, $NAND_{94}$, . . . , $NAND_{9n}$, and the shift register 212 includes (n/2) flip-flops $FF_{92}$, $FF_{94}$, . . . , $FF_{9n}$, and n OR gates $OR_{82}$, $OR_{84}$, . . . , $OR_{8n}$, and $OR_{92}$, $OR_{94}$, . . . , $OR_{9n}$.

Referring to FIGS. 30A, 30B and 31, the start signal VSP1' shown in FIG. 18 is inputted to the flip-flops $FF_{81}$ and $FF_{82}$, and the start signal VSP2" shown in FIG. 18 is inputted to the flip-flops $FF_{91}$ and $FF_{92}$. The NAND gate $NAND_{9(2j-1)}$ of the scan driver 201 performs a NAND operation of the output signals $SR_{8(2j-1)}$ and $SR_{8(2j+1)}$ of the flip-flops $FF_{8(2j-1)}$ and $FF_{8(2j+1)}$ and the clock VCLK to output the $(2j-1)^{th}$ select signal select[2*j*−1]. In addition, the NAND gate $NAND_{9(2j)}$ of the scan driver 202 performs a NAND operation of the output signals $SR_{8(2j)}$ and $SR_{8(2j+2)}$ of the flip-flops $FF_{8(2j)}$ and $FF_{8(2j+2)}$ and the inverted clock /VCLK to output the $(2j)^{th}$ select signal select[2*j*].

In the scan driver 201, the OR gate $OR_{8(2j-1)}$ performs an OR operation of the output signal $SR_{8(2j-1)}$ of the flip-flop $FF_{8(2j-1)}$ and the inverted output signal $/SR_{9(2j-1)}$ of the flip-flop $FF_{9(2j-1)}$ to output the $(2j-1)^{th}$ emission control signal emit1[2*j*−1]", and the OR gate $OR_{9(2j-1)}$ performs an OR operation of the output signals $SR_{8(2j-1)}$ and $SR_{9(2j-1)}$ of the flip-flops $FF_{8(2j-1)}$ and $FF_{9(2j-1)}$ to output the $(2j-1)^{th}$ emission control signal emit2[2*j*−1]". In the scan driver 202, the OR gate $OR_{8(2j)}$ performs an OR operation of the output signal $SR_{8(2j)}$ of the flip-flop $FF_{8(2j)}$ and the inverted output signal $/SR_{9(2j)}$ of the flip-flop $FF_{9(2j)}$ to output the $(2j)^{th}$ emission control signal emit1[2*j*]", and the OR gate $OR_{9(2j)}$ performs an OR operation of the output signals $SR_{8(2j)}$ and $SR_{9(2j)}$ of the flip-flops $FF_{8(2j)}$ and $FF_{9(2j)}$ to output the $(2j)^{th}$ emission control signal emit2[2*j*]".

The principles of the exemplary embodiment described in FIGS. 29 to 31 may also be applicable to the other exemplary embodiments described above.

In the above exemplary embodiments, the cases in which the select signals and the emission control signals provided by the scan driver are directly applied to the select scan lines and the emit scan lines have been shown. In other embodiments, however, one or more buffers may be formed between the display area 100 and the scan driver 200 (or the scan drivers 201 and 202). In addition, one or more level shifters which change the levels of the select signals and the emission control signals may also be formed between the display area 100 and the scan driver 200 (or the scan drivers 201 and 202).

According to the exemplary embodiments of the present invention, the plurality of sub-pixels share the select scan line and the pixel driver in the unit pixel. As a result, the sub-pixels can be easily arranged in the unit pixel, and the aperture ratio of the unit pixel can be improved. In addition, since the number of the select scan lines is reduced compared to that of the number of the row lines, the number of the output terminals and the dimension of the scan driver can be reduced. Further, since the dimension of the scan driver is reduced, the non-emission area can be reduced when the scan driver and the unit pixels are formed on the same substrate.

According to the other exemplary embodiments of the present invention, the number of the flip-flops can be reduced in the scan driver for outputting the select signals and the emission control signals of the first and second subfields.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A display device for displaying an image during a field comprising a plurality of subfields, the display device comprising:

a plurality of data lines extending in a column direction and for transmitting data signals;

a plurality of select scan lines extending in a row direction and for transmitting select signals;

a plurality of unit pixels arranged in rows at crossing regions of the data lines and select scan lines, each of the select scan lines being coupled to a corresponding one of the rows of the unit pixels, each of the unit pixels comprising a plurality of light emitting elements arranged in the column direction, and each of the light emitting elements of a respective one of the unit pixels being coupled to a same one of the select scan lines;

a plurality of emit scan lines for transmitting emission control signals, each of the emit scan lines being coupled to a corresponding one of the rows of the unit pixels; and a scan driver for applying the select signals to the select scan lines and for applying the emission control signals to the emit scan lines, in each of the plurality of subfields, wherein at least one of the unit pixels utilizes a corresponding one of the data signals in response to a first signal of a corresponding one of the select signals, and each of the plurality of light emitting elements of the at least one of the unit pixels emits light in response to an emit signal of a corresponding one of the emission control signals in a corresponding one of the subfields.

2. The display device of claim 1, wherein each of the unit pixels further comprises:

a pixel driver coupled in common to the light emitting elements of the respective one of the unit pixels and configured to store the corresponding one of the data signals in response to the first signal of the corresponding one of the select signals in each of the plurality of subfields, and to output a driving current corresponding to the corresponding one of the data signals, and each of the unit pixels further comprises:

a switching unit for selectively transmitting the driving current from the pixel driver to a corresponding at least one of the plurality of light emitting elements.

3. The display device of claim 2, wherein the plurality of light emitting elements of the at least one of the unit pixels emit lights of a same color.

4. The display device of claim 2, wherein the switching unit comprises a plurality of first transistors, each of the plurality of first transistors being coupled between an output terminal of the pixel driver and a corresponding one of the plurality of light emitting elements and being turned on in response to the emit signal of the corresponding one of the emission control signals, and wherein the plurality of first transistors are selectively turned on so that the driving current is selectively transmitted to the plurality of light emitting elements.

5. The display device of claim 4, wherein the pixel driver further comprises:

a second transistor having first, second, and third electrodes, wherein the driving current corresponding to a voltage between the first and second electrodes flows from the third electrode;

a first capacitor for storing a voltage corresponding to the corresponding one of the data signals; and a third transistor for transmitting the corresponding one of the data signals to the first capacitor in response to the first signal of the corresponding one of the select signals.

6. The display device of claim 5, wherein the pixel driver further comprises a second capacitor for storing a threshold voltage of the second transistor, and wherein the voltage between the first and second electrodes of the second transistor is determined by a voltage stored in the first and second capacitors.

7. The display device of claim 1, wherein each of the emission control signals includes a first emission control signal having a second signal as the emit signal and a second emission control signal having a third signal as the emit signal, and wherein each of the plurality of emit scan lines includes a first emit scan line for transmitting the first emission control signal and a second emit scan line for transmitting the second emission control signal.

8. A display device comprising:

a plurality of data lines extending in the column direction and for transmitting data signals;

a plurality of select scan lines extending in a row direction and for transmitting select signals;

a plurality of unit pixels arranged in rows at crossing regions of the data lines and select scan lines and for displaying an image during a field, the field being divided into a plurality of subfields, each of the select scan lines being coupled to a corresponding one of the rows of the unit pixels, each of the unit pixels comprising a plurality of light emitting elements arranged in the column direction, and each of the light emitting elements of a respective one of the unit pixels being coupled to a same one of the select scan lines;

a plurality of emit scan lines for transmitting emission control signals, each of the emit scan lines being coupled to a corresponding one of the rows of the unit pixels; and a scan driver for applying the select signals to the select scan lines and for applying the emission control signals to the emit scan lines, in each of the plurality of subfields, wherein at least one of the unit pixels uses a corresponding one of the data signals in response to a first signal of a corresponding one of the select signals, and each of the plurality of light emitting elements of the at least one of the unit pixels emits light in response to an emit signal of a corresponding one of the emission control signals in a corresponding one of the subfields, wherein each of the emission control signals includes a first emission control signal having a second signal as the emit signal and a second emission control signal having a third signal as the emit signal, wherein each of the plurality of emit scan lines includes a first emit scan line for transmitting the first emission control signal and a second emit scan line for transmitting the second emission control signal, and wherein the scan driver comprises:

a first shift register for sequentially outputting the select signals in each of the plurality of subfields; and a second shift register for sequentially outputting the first and second emission control signals.

9. The display device of claim 8, wherein the first shift register comprises:

a first driver for shifting at least one of first shift signals by a first period to sequentially output a plurality of the first shift signals, the first shift signals each having a fourth signal in each of the plurality of subfields; and a second driver for generating the first signal of the select signals during at least a part of a second period in which the fourth signal of one of the first shift signals at least partly overlaps with the fourth signal of another one of the first shift signals.

10. The display device of claim 9, wherein the second driver receives a signal having a plurality of fifth signals whose cycle is the first period, and generates the first signal of at least one of the select signals during a period in which the received signal has the fifth signal, of the second period.

11. The display device of claim 9, wherein a width of the fourth signal is twice that of the first period.

12. The display device of claim 9, wherein the second shift register comprises:

a third driver for shifting at least one of second shift signals by the first period to sequentially output a plurality of the second shift signals, the second shift signals each having a fifth signal and a sixth signal in the field;

a fourth driver for generating the second signal of the first emission control signal during a period in which a corresponding one of the second shift signals has the fifth signal and a corresponding one of the first shift signals does not have the fourth signal; and a fifth driver for generating the third signal of the second emission control signal during a period in which a corresponding one of the second shift signals has the sixth signal and a corresponding one of the first shift signals does not have the fourth signal.

13. The display device of claim 8, wherein the second shift register comprises:

a first driver for sequentially outputting the first emission control signal; and a second driver for inverting the first emission control signal to sequentially output the second emission control signal.

14. The display device of claim 8, wherein the second shift register comprises:

a first driver for shifting at least one of first shift signals by a first period to sequentially output a plurality of the first shift signals, the first shift signals each having a fourth signal and a fifth signal in the field;

a second driver for generating the second signal of the first emission control signal during a period in which the fourth signal of one of the first shift signals at least partly overlaps with the fourth signal of another one of the first shift signals; and a third driver for generating the third signal of the second emission control signal during a period in which the fifth signal of one of the first shift signals at least partly overlaps with the fifth signal of another one of the first shift signals.

15. The display device of claim 8, wherein the first shift register shifts at least one of the select signals by a first period to sequentially output the select signals in each of the plurality of subfields, and wherein the second shift register shifts at least one of the emission control signals by a second period corresponding to twice the first period, to sequentially output the emission control signals, and applies a same one of the emission control signals to two of the unit pixels to which first and second select signals of the select signals are applied, the second select signal being shifted by the first period from the first select signal.

16. The display device of claim 15, wherein the first shift register receives a first shift signal having a fourth signal and a fifth signal in turn with a cycle of the second period, and comprises:

a first driver for shifting at least one of second shift signals by the second period to sequentially output a plurality of the second shift signals, the second shift signals each having a sixth signal in each of the plurality of subfields;

a second driver for generating the first signal of the first select signal during at least a part of a period in which the sixth signals of two of the second shift signals at least partly overlap and the first shift signal has the fourth signal; and a third driver for generating the first signal of the second select signal during at least a part of a period in which the sixth signals of two of the second shift signals at least partly overlap and the first shift signal has the fifth signal.

17. The display device of claim 16, wherein the second shift register comprises:

a fourth driver for shifting at least one of third shift signals by the second period to sequentially output a plurality of the third shift signals, the third shift signals each having a seventh signal and an eighth signal in the field;

a fifth driver for generating the second signal of the first emission control signal during a period in which a corresponding one of the third shift signals has the seventh signal and a corresponding one of the second shift signals does not have the sixth signal; and a sixth driver for generating the second signal of the second emission control signal during a period in which a corresponding one of the third shift signals has the eighth signal and a corresponding one of the second shift signals does not have the sixth signal.

18. The display device of claim 7, wherein the scan driver comprises a shift register for sequentially outputting the select signals in each of the plurality of subfields and for sequentially outputting the emission control signals.

19. The display device of claim 18, wherein the shift register comprises:

a first driver for shifting at least one of first shift signals by a first period to sequentially output a plurality of the first shift signals, the first shift signals each having a fourth signal and a fifth signal in the field; and a second driver for generating the first signal of at least one of the select signals during at least a part of a period in which two of the first shift signals shifted from each other by the first period have different signals.

20. The display device of claim 19, wherein the shift register further comprises:

a third driver for generating the second signal of the first emission control signal in response to the fourth signal of a corresponding one of the first shift signals; and a fourth driver for generating the third signal of the second emission control signal in response to the fifth signal of a corresponding one of the first shift signals.

21. The display device of claim 19, wherein the shift register further comprises:

a third driver for generating the second signal of the first emission control signal during a period in which the fourth signal of one of the first shift signals at least partly overlaps with the fourth signal of another one of the first shift signals; and a fourth driver for generating the third signal of the second emission control signal during a period in which the fifth signal of one of the first shift signals at least partly overlaps with the fifth signal of another one of the first shift signals.

22. The display device of claim 18, wherein the shift register comprises:

a first driver for shifting at least one of first shift signals by a first period to sequentially output a plurality of the first shift signals, the first shift signals each having a fourth signal and a fifth signal in the field;

a second driver for generating the second signal of the first emission control signal during a period in which the fourth signal of one of the first shift signals at least partly overlaps with the fourth signal of another one of the first shift signals;

a third driver for generating the third signal of the second emission control signal during a period in which the fifth signal of one of the first shift signals at least partly overlaps with the fifth signal of another one of the first shift signals; and a fourth driver for generating the first signal of at least one of the select signals during at least a part of a period in which the first emission control signal does not have the second signal and the second emission control signal does not have the third signal.

23. The display device of claim 18, wherein the shift register comprises:

a first driver for shifting at least one of first shift signals by a first period to sequentially output a plurality of the first shift signals, the first shift signals each having a fourth signal and a fifth signal in the field;

a second driver for generating a sixth signal of at least one of the second shift signals during a period in which the fourth signal of one of the first shift signals at least partly overlaps with the fourth signal of another one of the first shift signals;

a third driver for generating a seventh signal of at least one of the third shift signals during a period in which the fifth signal of one of the first shift signals at least partly overlaps with the fifth signal of another one of the first shift signals;

a fourth driver for generating the second signal of the first emission control signal during a period in which the sixth signal of one of the second shift signals at least partly overlaps with the sixth signal of another one of the second shift signals; and a fifth driver for generating the third signal of the second emission control signal during a period in which the seventh signal of one of the third shift signals at least partly overlaps with the seventh signal of another one of the third shift signals.

24. The display device of claim 23, wherein the shift register further comprises a sixth driver for generating the first signal of at least one of the select signals during at least a part of a period in which two of the first shift signals shifted from each other by the first period have different signals.

25. The display device of claim 23, wherein the shift register further comprises a sixth driver for generating the first signal of at least one of the select signals during at least a part of a period in which a corresponding one of the second shift signals does not have the sixth signal and a corresponding one of the third shift signals does not have the seventh signal.

26. The display device of claim 1, wherein the scan driver is formed on one side of a display area in which the plurality of unit pixels are formed.

27. The display device of claim 1, wherein the light emitting elements comprise organic light emitting diodes.

* * * * *